US007823316B2

(12) United States Patent
Storch et al.

(10) Patent No.: US 7,823,316 B2
(45) Date of Patent: Nov. 2, 2010

(54) ADJUSTABLE GUN RAIL LOCK

(75) Inventors: Troy Storch, Waukesha, WI (US); John Gross, Mukwanago, WI (US); William Orne, III, New Berlin, WI (US); Eric Stephen Kincel, Tucson, AZ (US)

(73) Assignee: American Defense Manufacturing, LLC, New Berlin, WI (US)

( * ) Notice: Subject to any disclaimer, the term of this patent is extended or adjusted under 35 U.S.C. 154(b) by 0 days.

(21) Appl. No.: 12/024,619

(22) Filed: Feb. 1, 2008

(65) Prior Publication Data

US 2008/0178511 A1 Jul. 31, 2008

(51) Int. Cl.
*F41G 1/38* (2006.01)

(52) U.S. Cl. ..... 42/90; 42/127

(58) Field of Classification Search ..... 42/90, 42/124, 127, 140, 125
See application file for complete search history.

(56) References Cited

U.S. PATENT DOCUMENTS

| | | | | |
|---|---|---|---|---|
| 3,324,558 | A * | 6/1967 | Hart | 42/127 |
| 4,531,321 | A | 7/1985 | Bechtel | |
| 4,724,692 | A * | 2/1988 | Turin et al. | 70/225 |
| 5,276,988 | A * | 1/1994 | Swan | 42/127 |
| 6,196,504 | B1 * | 3/2001 | Lemke | 248/187.1 |
| 6,435,738 | B1 * | 8/2002 | Vogt | 396/419 |
| 6,442,883 | B1 * | 9/2002 | Waterman et al. | 42/124 |
| 6,648,287 | B2 | 11/2003 | Wooten | |
| 6,701,081 | B1 | 3/2004 | Dwyer et al. | |
| 6,705,038 | B2 | 3/2004 | Davenport et al. | |
| 6,722,076 | B2 | 4/2004 | Nielsen | |
| 6,773,172 | B1 * | 8/2004 | Johnson et al. | 396/428 |
| 6,779,290 | B1 * | 8/2004 | Houtsma | 42/148 |
| 6,785,997 | B2 | 9/2004 | Oz | |
| 6,792,711 | B2 | 9/2004 | Battaglia | |
| 6,851,214 | B2 | 2/2005 | Oz | |
| 6,854,206 | B2 | 2/2005 | Oz | |
| 6,922,934 | B1 | 8/2005 | Huan | |
| 6,923,412 | B2 | 8/2005 | Wooten et al. | |
| 6,931,778 | B1 * | 8/2005 | Nelson et al. | 42/120 |
| 6,931,779 | B1 | 8/2005 | Galuppo | |
| 7,077,582 | B2 * | 7/2006 | Johnson | 396/428 |
| 7,090,174 | B2 | 8/2006 | Korczak et al. | |
| 7,096,620 | B2 | 8/2006 | Zeh | |

(Continued)

FOREIGN PATENT DOCUMENTS

| | | |
|---|---|---|
| JP | 97395 | 4/2000 |

(Continued)

OTHER PUBLICATIONS

Technical Manual, TM 9-4931-710-14&P, dated Aug. 1986, Department of the Army.

(Continued)

*Primary Examiner*—Michael Carone
*Assistant Examiner*—Reginald Tillman, Jr.
(74) *Attorney, Agent, or Firm*—Boyle Fredrickson, S.C.

(57) ABSTRACT

Systems and methods for mounting accessories to a firearm are disclosed. The systems include a rail connector and quick release device for mounting on a firearm. The connector includes at least one mounting rail and a fastening member for securely fastening the connector directly to the firearm. The quick release is then mounted to the mounting rail.

15 Claims, 25 Drawing Sheets

U.S. PATENT DOCUMENTS

| | | | | |
|---|---|---|---|---|
| 7,107,716 | B1 * | 9/2006 | Liao | 42/108 |
| 7,185,862 | B1 | 3/2007 | Yang | |
| 7,204,052 | B2 * | 4/2007 | Swan | 42/127 |
| 7,222,451 | B2 | 5/2007 | Da Keng | |
| 7,243,456 | B2 | 7/2007 | Williams | |
| 7,260,912 | B2 | 8/2007 | Liu | |
| 7,272,904 | B2 | 9/2007 | Larue | |
| 7,308,772 | B1 | 12/2007 | Millett | |
| 7,370,449 | B1 * | 5/2008 | Beckmann | 42/90 |
| D573,443 | S * | 7/2008 | Swan | D8/343 |
| 7,493,721 | B2 * | 2/2009 | Swan | 42/125 |
| 7,562,485 | B2 * | 7/2009 | Newhall et al. | 42/127 |
| 2006/0117636 | A1 * | 6/2006 | Newhall et al. | 42/124 |
| 2008/0092421 | A1 * | 4/2008 | Beckmann | 42/90 |

FOREIGN PATENT DOCUMENTS

| | | |
|---|---|---|
| WO | WO/93/15371 | 1/1993 |
| WO | WO/2005/085744 | 3/2005 |
| WO | WO/2006/050163 | 5/2006 |
| WO | WO/2007/067569 | 12/2006 |

OTHER PUBLICATIONS

International Search Report (ISR) and the Written Opinion (PCT/US2009/032837).

* cited by examiner

ADJUSTABLE GUN RAIL LOCK

CROSS-REFERENCE TO RELATED APPLICATIONS

This application claims the benefit of U.S. Ser. Nos. 60/884,812, filed Jan. 12, 2007, and 11/959,020, filed Dec. 18, 2007, the disclosures of which are hereby incorporated in their entirety by reference.

BACKGROUND OF THE INVENTION

1. Field of the Invention

The present invention relates in general to the field of firearms. More particularly, the present invention relates to gun mounts. Specifically, a preferred embodiment of the present invention relates to a quick release-mounting device for a weapon.

2. Discussion of the Related Art

As the field of combat weaponry expands, numerous add-on enhancements have become available for attachment to standard firearms thereby significantly upgrading the capability of the firearm. However, because of the variety of shapes of the upper receivers of different firearms, the add-on enhancements must be modified each time they are sold for a different firearm. This also results in high cost for the add-on enhancements.

The Swan/Weaver rail described in U.S. Pat. No. 4,845,871, incorporated herein by reference and hereinafter referred to as the '871 patent, addresses a portion of this problem. The female portion of the rail is a quick detachable interface means for modular enhancements. However, the rail requires a first rail (Weaver rail) to be attached to the firearm, typically to the arced handle on the U.S. Army M16 combat firearm, and different means on other types. The first rail must be designed for each firearm to accommodate the differences between firearm receivers. Since the male portion of the Swan/Weaver rail is easily removed by the firearm operator, they are also easily lost and calibration and weapon sighting are difficult and nonuniform.

As mentioned, the increasing complexity of combat has generated a need for weapons with increased accuracy and which are capable of supporting various accessories. These accessories include flashlights, infrared and night vision scopes, laser spotters, and so forth. Consequently, a wide variety of mounts for rifles and other hand weapons have been developed which permit mounting on the weapon, often along the barrel.

These modular weapon systems generally include Picatinny rails or other such rails or tracks, often using MIL-STD-1913 for standardization of the mounting systems, and are affixed to the barrel or stock of the weapon for mounting accessories thereon. A variety of designs have been suggested for such modular weapon systems and such rails, as well as differing numbers of rails, which can be coupled at one time to a weapon. At present, it is known to mount up to four rails to a weapon.

Since the rails are generally mounted on the handguard (or handguard replacement) of the weapon, accessories mounted thereon must be zeroed often, since the alignment of the accessory relative to the barrel changes slightly during firing of the weapon or if the weapon receives a shock (i.e., falls).

Recently, floating rails have been suggested such as rails attached to a weapon in such a way as not to contact the barrel. These generally are attached at the rear only, in order to attempt to provide more stability over time. However, these rails, also, suffer from alignment problems due to the shock created by the gases during firing. In addition, most of these rails can be mounted only by an armorer, by taking apart the barrel and sight and reassembling the weapon with the floating rails.

The below-referenced U.S. patents and published U.S. applications disclose embodiments that were at least in part satisfactory for the purposes for which they were intended. The disclosures of all of the below-referenced prior United States patents and applications, in their entireties, are hereby expressly incorporated by reference into the present application for purposes including, but not limited to, indicating the background of the present invention and illustrating the state of the art.

U.S. Pat. No. 7,096,620 to Zeh entitled "Device for mounting a telescopic sight on a weapon" is a device for mounting a telescopic sight onto a weapon. The device is equipped with two mounting feet, which are positioned at a distance from one another and provided with mounting elements for engaging in corresponding receiving openings on the weapon. The aim of the invention is to enable the sight to be positioned accurately without the need for a complex adjustment and fitting process. To achieve this, the mounting elements are configured by clamping bolts, which comprise laterally protruding lugs, are contained in the corresponding mounting feet and can be rotated through a release and locking position. The lugs can be inserted into recesses between inward-facing projecting shoulders of the receiving openings in the release position of the clamping bolts and engage with the underside of the projecting shoulders in the locked position of the bolts.

U.S. Pat. No. 6,785,997 to Oz discloses an "Accessory mount for a firearm." The accessory mount, and a method for mounting accessories for a hand held firearm has a barrel and a mounting rail coupled beneath the barrel. The accessory mount includes a frame, defining a substantially flattened bottom surface and a track for mounting along the mounting rail. The frame has a cavity for receiving a light, and a bipod mount coupled adjacent the track and behind the light cavity and arranged to hold a bipod having legs which can be folded substantially adjacent the barrel.

U.S. Pat. No. 6,851,214 to Oz discloses a "Flashlight mount for a firearm." The flashlight mount, and a method for mounting a flashlight, for a rifle having a barrel and a mounting rail coupled to the barrel includes a frame having a bore for receiving a flashlight. The frame defines a substantially flattened bottom surface, and a base for mounting along the mounting rail. The base is distanced from the frame, thereby creating a finger-receiving aperture therebetween.

U.S. Pat. No. 5,590,484, to Mooney et al., discloses a universal mount for a rifle which is formed to support a series of accessory devices simultaneously. The mount comprises an upper rail, a lower rail, a heat shield, and a retaining clip. When in place, this mount enables the rifle to be used as a weapons' platform, simultaneously supporting a plurality of accessory devices that enhance the operational capabilities of the weapon. A major feature of this invention is that the mount is secured to the barrel so that it "follows" the direction of the barrel when the latter undergoes thermal deformation as a result of firing successive rounds of ammunition. This enables the weapon to remain accurate despite the number of rounds fired or the temperature of the barrel.

U.S. Pat. No. 6,318,015 to Baumann, et al., discloses a holding device for a weapon barrel which includes a casing extension on the casing of the weapon, and a longitudinal rail integrally formed on the top of the casing and on the casing extension as a mounting for the telescopic sight.

U.S. Pat. No. 5,881,486 to Bilgeri et al. discloses a hand-held firearm with a light casing. This firearm also includes a casing extension having a mounting for a telescopic sight.

U.S. Pat. No. 5,685,105 to Teetzel discloses an apparatus for attaching an accessory to a firearm. This apparatus includes a chassis containing a flashlight that can be mounted in various positions, depending on the weapon selected. The weapons factory installed hand grips are replaced by modified hand grips that contain the flashlight electronic controls, water proof activation switches, and power source.

Other U.S. patents of interest include U.S. Pat. Nos. 4,845,871, 5,276,988, and 5,142,806 to Swan, U.S. Pat. No. 6,026,582 LaRue.

Some of the above devices suffer from a number of disadvantages. First, conventional mounts are substantially cylindrical in cross-section, such that their bottom surface is curved, so they provide no stability if the weapon is leaned upon a wall, for example. Second, often the mounts are relatively small, so as to permit mounting of several different accessories and reduce weight. However, this structure makes it difficult to comfortably grip the weapon while holding the mount, and often places the user's hand in close proximity to the hot barrel during firing. Third, conventional mounts generally have a selected location along the barrel at which they are affixed. Thus, this location is often not optimal for users of different heights and different arm lengths.

Accordingly, there is a long felt need for an accessory mount for a rifle or other hand-held firearm which provides a strong grip and stability for the weapon, and it would be desirable to have such a mount whose mounting location along the barrel is adjustable according to the length of the arm of the user.

Therefore, what is needed is a rail and quick release mount that is easy to use, durable, flexible, will not damage the rifle or the mounting rail, and does not require special tools to mount.

SUMMARY AND OBJECTS OF THE INVENTION

By way of summary, the present invention provides a mounting system for a rifle or carbine, such as an AR-15, M-16, or other firearm, such as a mounted .50 caliber machine gun, preferably having a barrel and a mounting rail coupled to the barrel. The mounting system includes a frame defining a substantially flattened bottom surface, and a base for mounting along the mounting rail, the base being distanced from the frame, creating a finger-receiving aperture therebetween.

The present invention generally includes a system for mounting an accessory to a firearm rail. The mounting system includes a mounting device that is selectively attachable to the rail of a firearm. The system further includes a locking mechanism attached to the mounting device. The locking mechanism is configured to secure the mounting device to the rail of the firearm. There is thus provided, in accordance with the present invention, a quick-release mounting device for mounting an accessory such as, for example, a front sight, to a firearm.

In one embodiment, the accessory may include a high-powered scope, night vision sight, or other such accessory. The accessory sits on top of the gun barrel or the rail mount. The goal is to provide a quick-release mechanism that will not jam up when it gets dirty or is subject to extreme conditions such as hot or cold.

In another embodiment of the present invention, the mounting device comprises a base and a frame coupled together by way of a connecting rod or yoke. The frame and base are preferably spring biased with respect to one another so as to accommodate rails of varying size therebetween. The system preferably further comprises a locking mechanism comprising a lever with an integrally disposed button. The locking mechanism is configured to be selectively in communication with a cam member having a notch on a surface thereof.

In yet another embodiment of the present invention, a mount for a firearm comprises a two-piece mounting device having a base and a frame coupled to one another and having a bottom cavity designed to receive a rail of a firearm therebetween. In addition, a lever mechanism is provided for adjusting the distance between the frame and the base to thereby accommodate varying rail sizes therebetween.

In still another embodiment, a mounting device for receiving a rail of a barrel of a firearm includes a base having a downwardly facing receiving side defining a channel. A frame is coupled to the base by way of a connecting rod or yoke defining a gap therebetween and defining a second channel. The frame and base are preferably spring-biased with respect to one another. A locking mechanism comprising a cam having a notch on a surface thereof is also provided. The cam is configured to selectively receive a button disposed within a cavity of a lever to lock the base with respect to the frame.

One object of the invention is to provide an apparatus that is ruggedized and reliable, thereby decreasing down time and operating costs. Another object of the invention is to provide an apparatus that has one or more of the characteristics discussed above but which is relatively simple to manufacture and assemble using a minimum of equipment.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
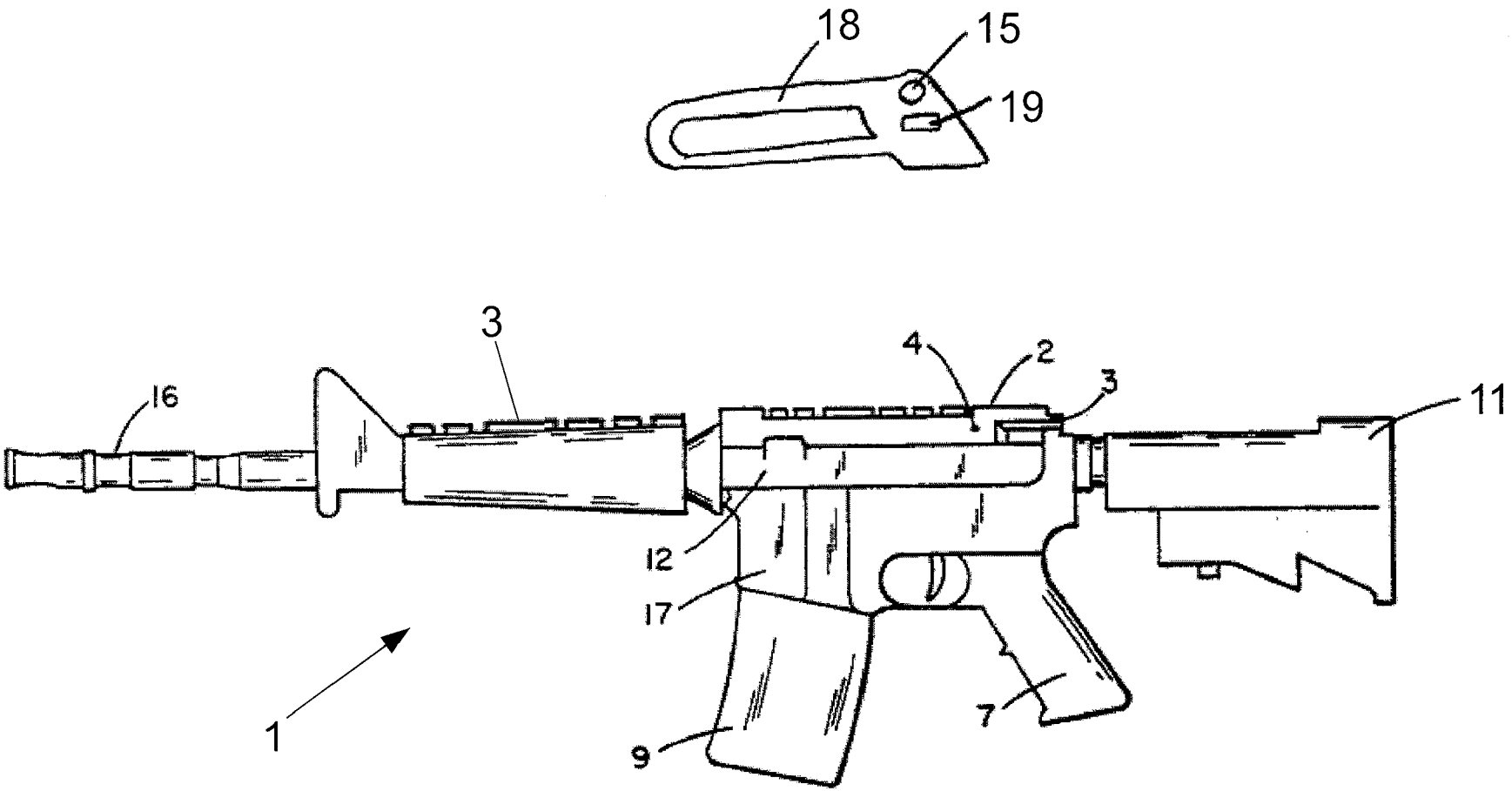
FIG. 1 is a side view of an assault rifle to which the present invention may be mounted.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word "connected", "attached", or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

1. System Overview

The invention solves the problem of having a locking mechanism that automatically locks the scope or other accessory onto a rail mount or rail system. As tolerances of the rail may be off, the locking mechanism of the present invention may be adjusted without the use of specialized tools to maintain a constant tension and add durability.

2. Detailed Description

Referring to the drawings in detail wherein like elements are indicated by like numerals, there is shown in FIG. 1 an outline of a conventional combat firearm 1 having a conventional stock 11, upper receiver 12, lower receiver 17, barrel 16, pistol grip 7, magazine 9, and arced handle 18 is preferably joined to the upper receiver 12. The barrel 16 is also joined to the upper receiver 12, i.e., the upper receiver 12 "receives" the barrel 16. The arced handle 18 has the after part of a non-optical bead sight with windage and elevational adjustment devices 15, 19 located at the rear thereof remote from the barrel 16.

Figure 2A:
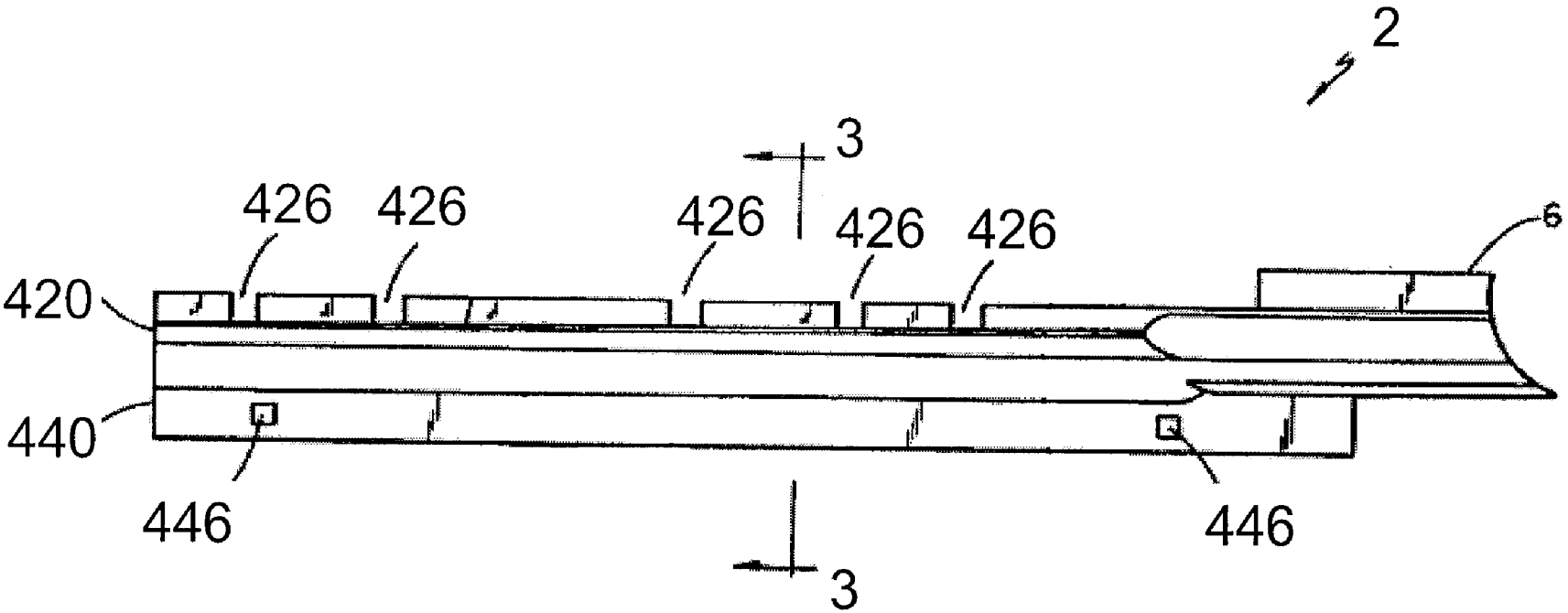
FIG. 2A is a side view of a mount of the present invention.
Figure 2B:
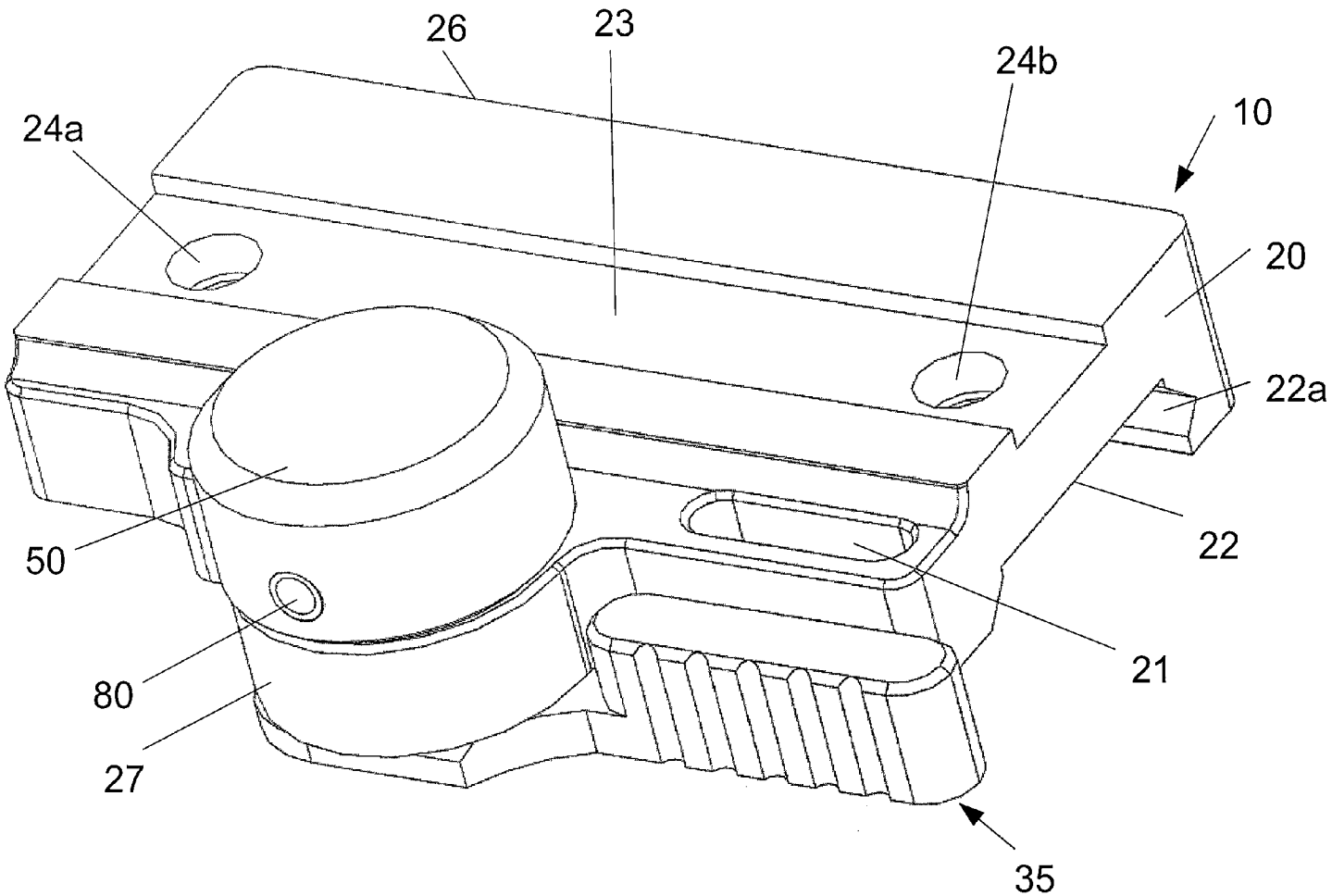
FIG. 2B is a perspective top down view of a device of the present invention which may be mounted on the mount of FIG. 2A.

FIG. 2A shows a typical receiver and mount system including a rail. As may be seen in FIG. 2A, the receiver sleeve 2 has a top section 420 and a bottom section 440 and a longitudinal axis extending in spaced, parallel relation to the longitudinal axis of the firearm 1. The top section preferably contains a rail 3. Optional notches 426 in the rail 3 provide additional means of engaging other components. The quantity and placement of pairs of notches 426 are as required or needed.

The outer transverse width of the receiver sleeve top section 420 is 0.835 inches. The dimensions of the receiver sleeve top section 420 remain the same regardless of the firearm the receiver sleeve 2 is attached to. This ensures that all modular enhancements need meet only one interface requirement, regardless of the firearm. The receiver sleeve top section 420 is joined to the receiver sleeve bottom section 440.

In the embodiment shown in FIG. 2A, the outer transverse width of the receiver sleeve top section 420 is 0.835 inches. The dimensions of the receiver sleeve top section 420 remain the same regardless of the firearm the receiver sleeve 2 is attached to. This ensures that all modular enhancements need meet only one interface requirement, regardless of the firearm. In this embodiment of the invention, the receiver sleeve 2 has pins 4 affixing it to the firearm upper receiver 12 to prevent removal from the firearm 1 by other than an official armorer. Each pin 4 passes through one of a plurality of holes 446 formed transversely through said bottom section for pinning said receiver sleeve 2 to said firearm upper receiver 12. In practice, the receiver sleeve 2 would incorporate a standard non-optical, flip up sight 6 at the rear of the receiver top section 420. Windage and elevational adjustments 15 and 19 may also be included.

The conventional firearm handle was removed in order to install the receiver sleeve 2. However, handle 18 is available for semi-permanent, non-removable installation on the receiver sleeve 2 of the present invention for firearm users who do not require optics. The handle 18 is preferably installed directly to the receiver sleeve top section 420 and also has pin holes 446 for pinning to the receiver sleeve top section 420 thereby preventing removal by anyone other than an official armorer. Another embodiment of a handle is shown in the '871 patent. This handle has two fastener devices of the '871 patent type incorporated into the handle base 15. As illustrated in the '817 patent, the handle may thereby be attached about the receiver sleeve top section 420 and used to carry the firearm 1.

FIGS. 2B, 3, 4, and 5 show one embodiment of the quick release attaching device 10 of the present invention. Here, the device 10 consists of base 20, which can receive a rail 3 of a receiver 2 attached to the barrel 16 of a firearm 1. The base 20 has a slot 21 on one edge. On a bottom side of the base 20 is a receiving cavity 22 which includes receiving cavity groove 22*a*. A top side of the base 20 has a slot or groove 23. The base also includes mounting bores 24*a* and 24*b*. Along one edge of the base is a first wall 26 which is generally straight. Opposite the first wall 26 is the second wall 27 that includes a flange 27*a* and a protrusion 27*b*. Also included in the base 20 is a lever receiving bore 28. The bore 28 is preferably countersunk so that it begins with a wider bore 28*a* and is reduced to smaller bore 28*b* as shown.

Figure 7:
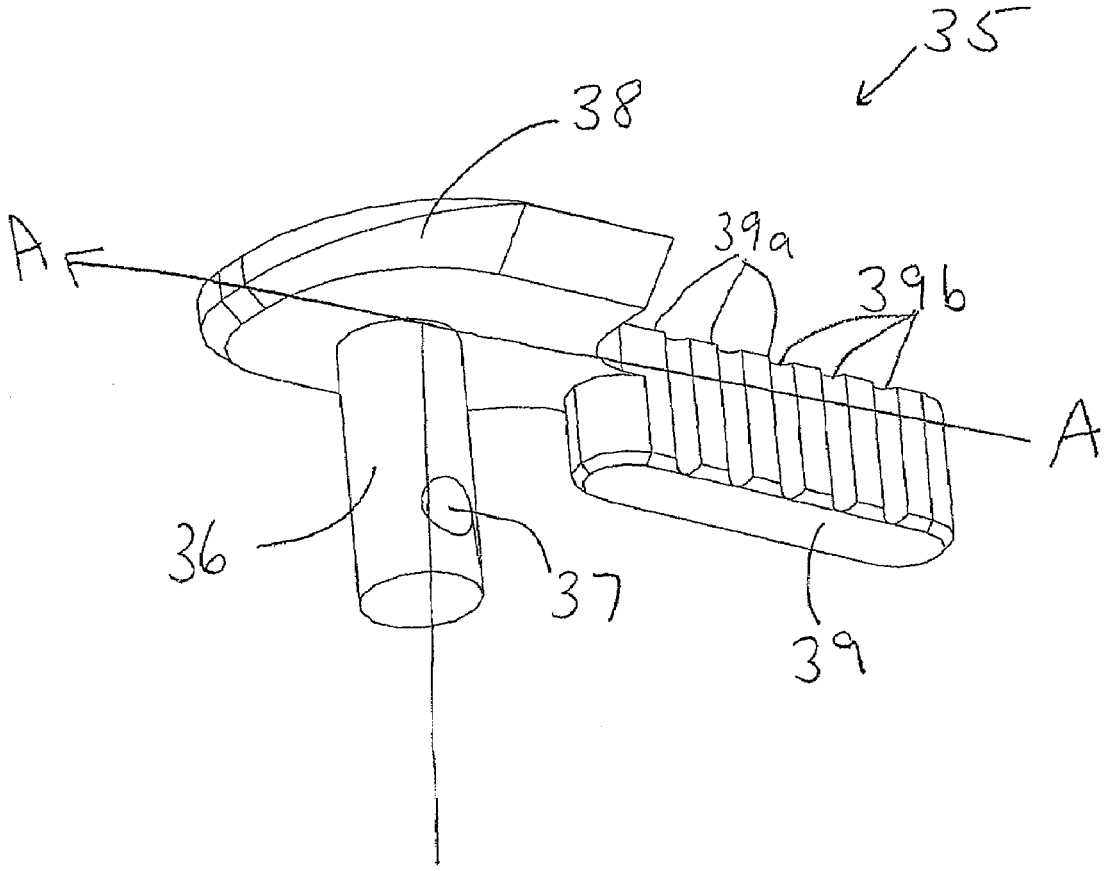
FIG. 7 is a perspective view of the lever of FIG. 3.
Figure 8:
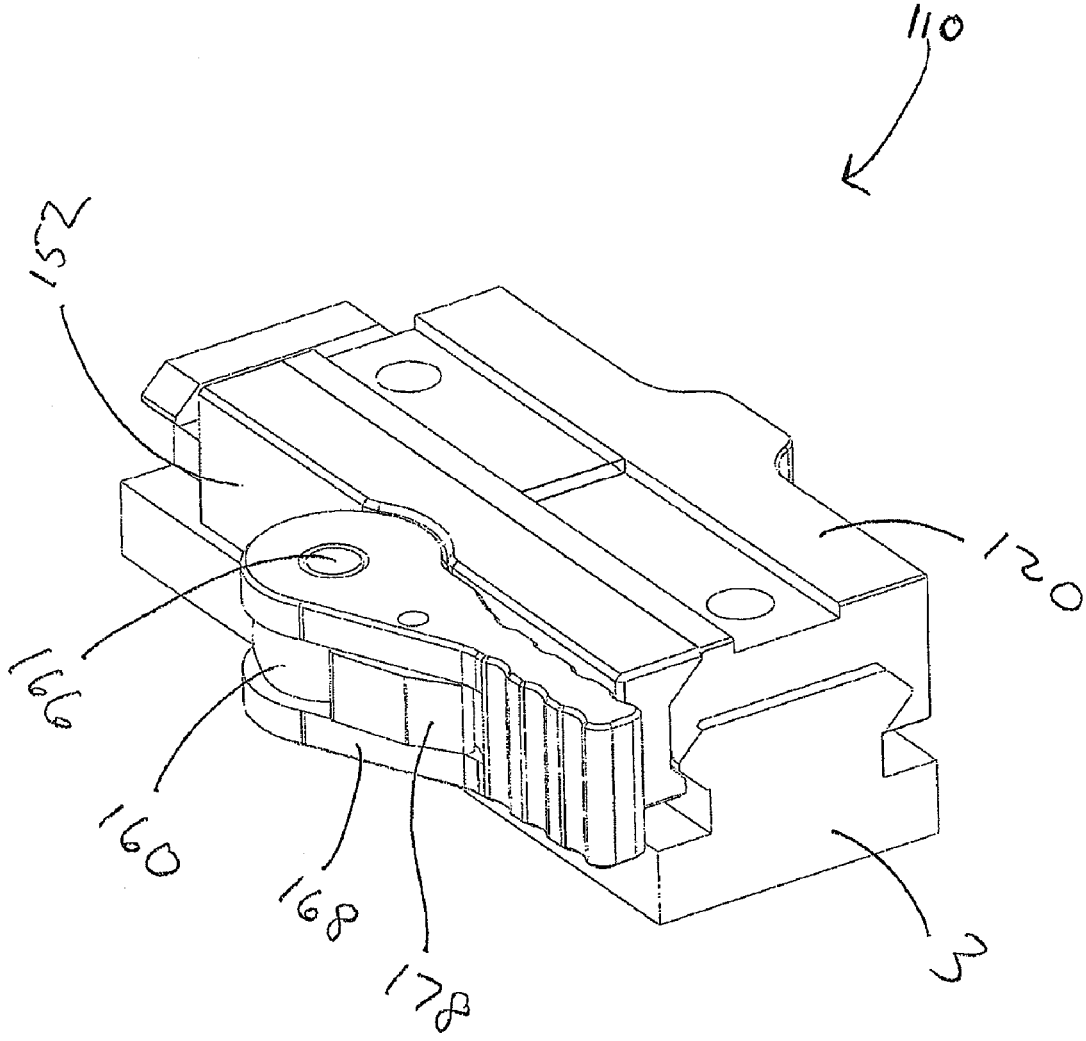
FIG. 8 is a perspective view of another embodiment of the device of the present invention.
Figure 9:
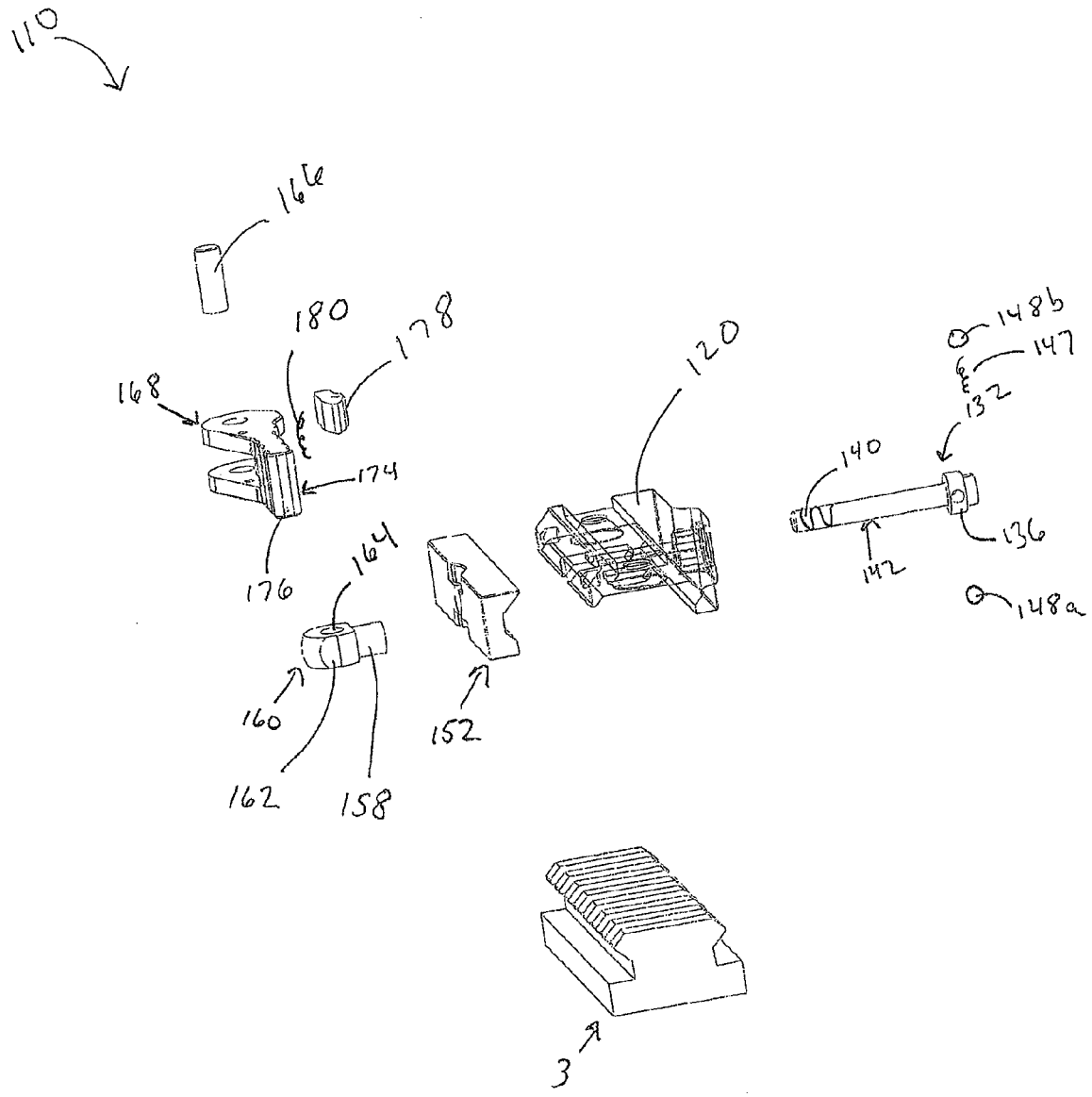
FIG. 9 is an exploded perspective view of the embodiment shown in FIG. 8.
Figure 10:
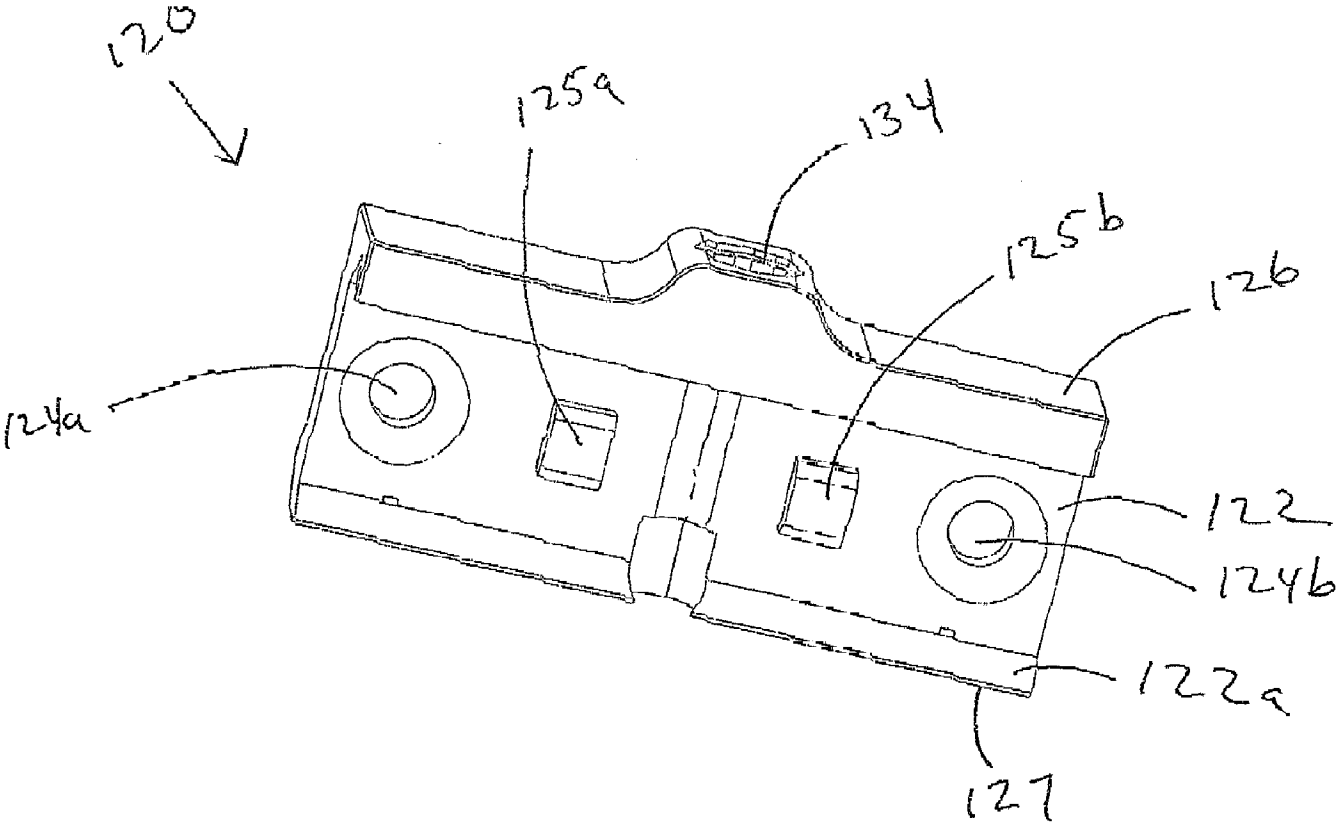
FIG. 10 is a perspective view showing the bottom of the base of the embodiment illustrated in FIG. 8.
Figure 11:
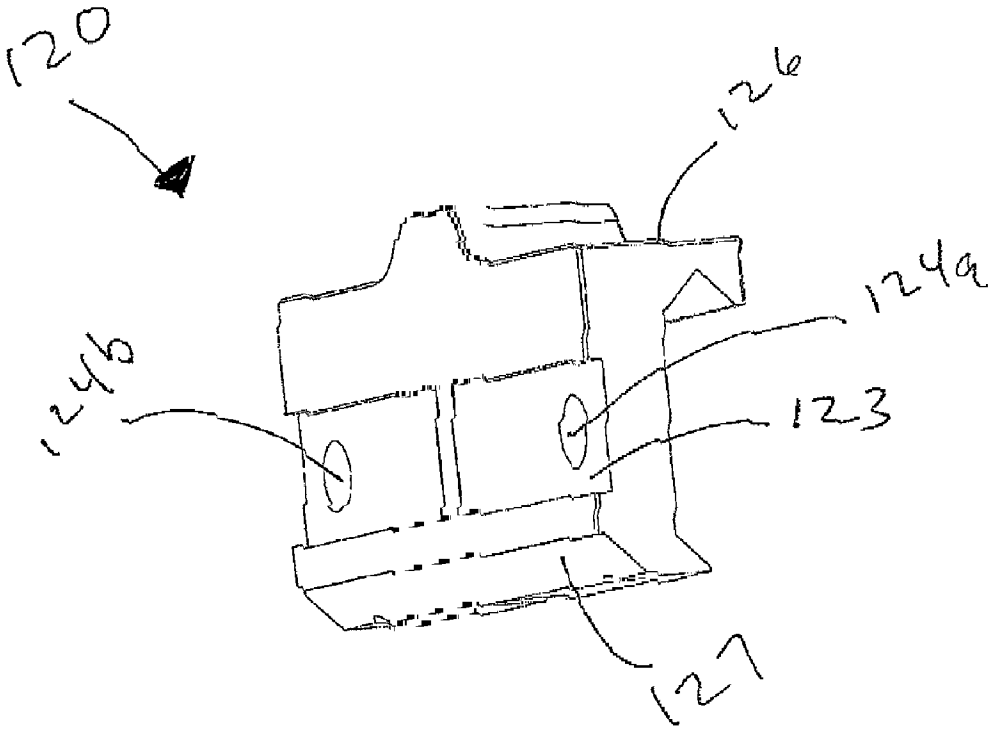
FIG. 11 is a perspective view of the top of the base of the embodiment illustrated in FIG. 8.
Figure 12:
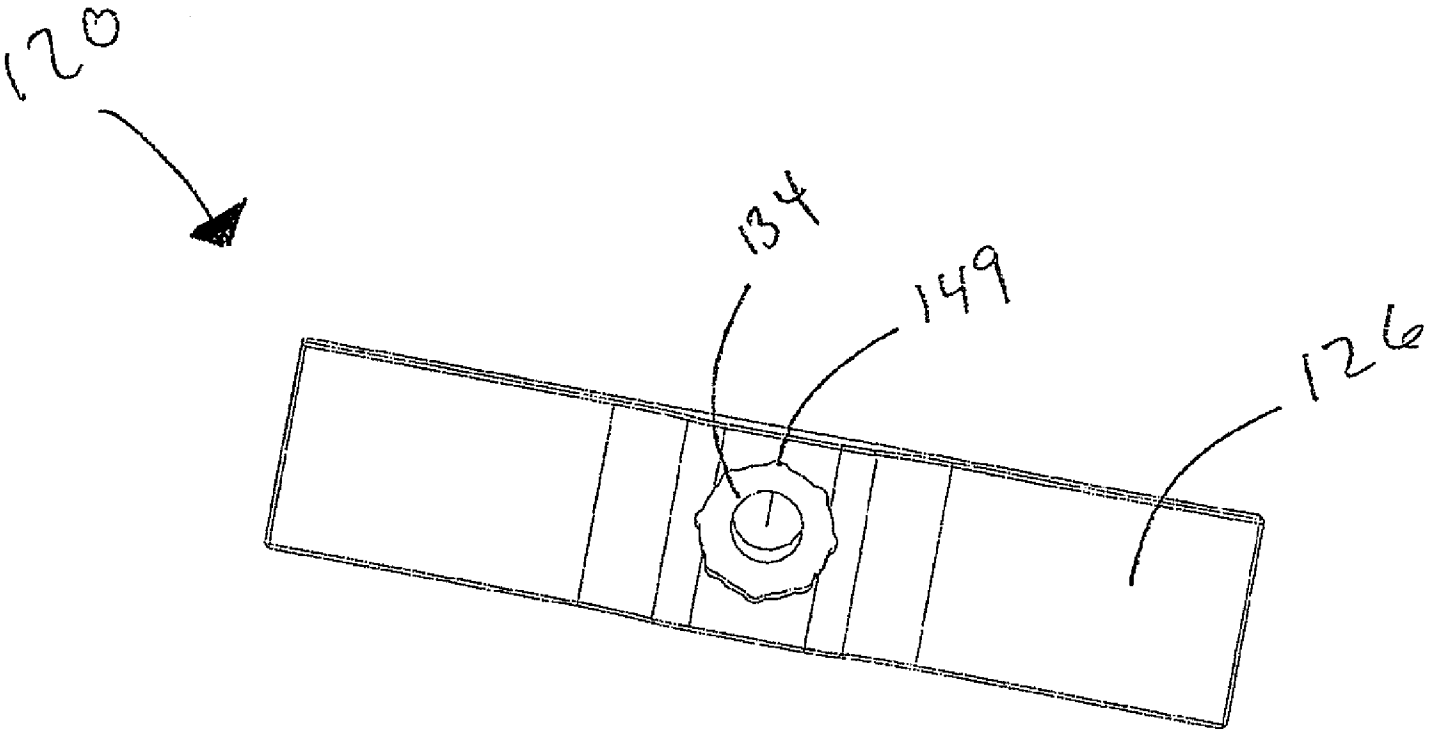
FIG. 12 is a top view of the base of the embodiment illustrated in FIG. 8.
Figure 13:
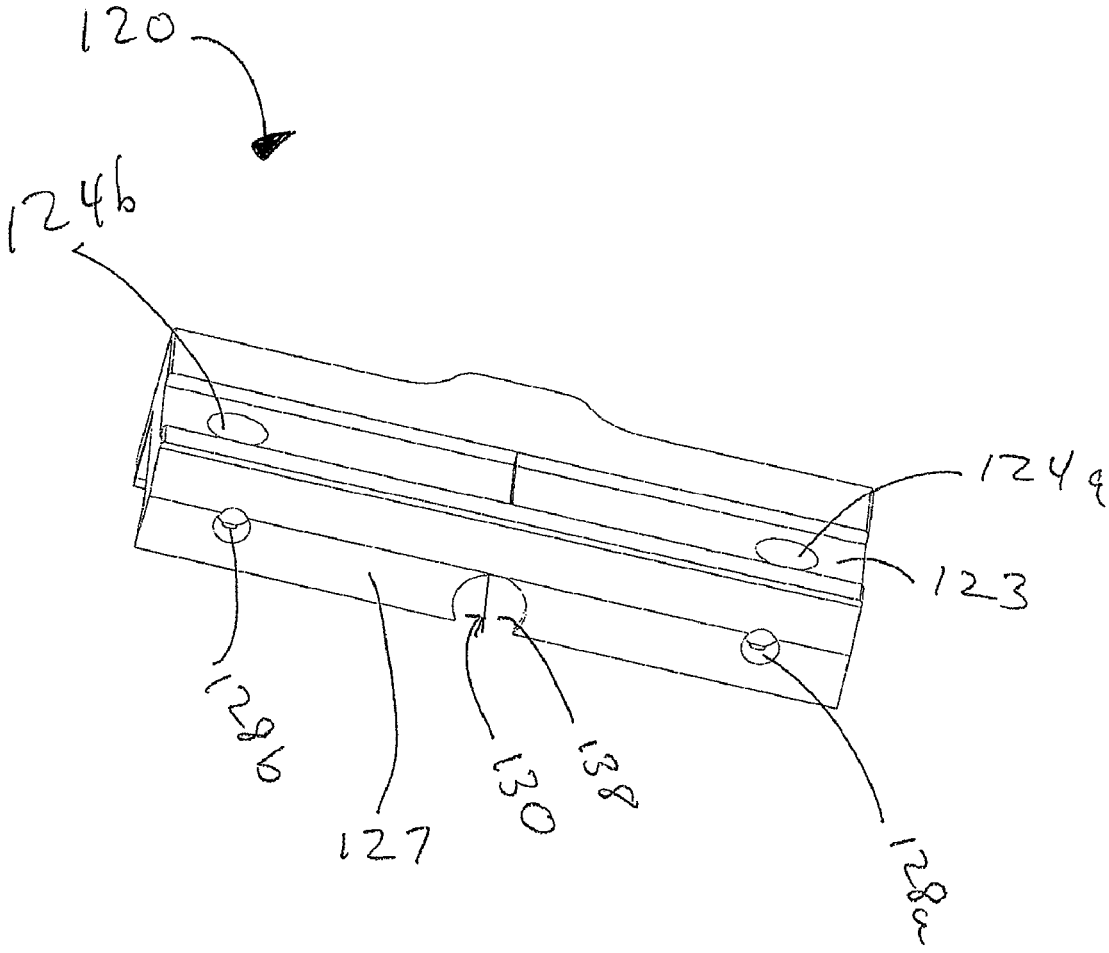
FIG. 13 is a side perspective view of the base of the embodiment illustrated in FIG. 8.

The lever 35 preferably includes a shaft 36 perpendicular to an axis A (see FIG. 7). The shaft 36 has a mounting bore 37 therethrough. The shaft 36 is attached to stand 38 that is a generally flat piece of metal. The arm 39 of the lever 35 is connected to the stand 38. The arm preferably has lands 39*a* and grooves 39*b* that add a textured surface to the arm 39. This textured surface allows for better gripping of the lever arm by a firearm operator in the field.

Figure 3:
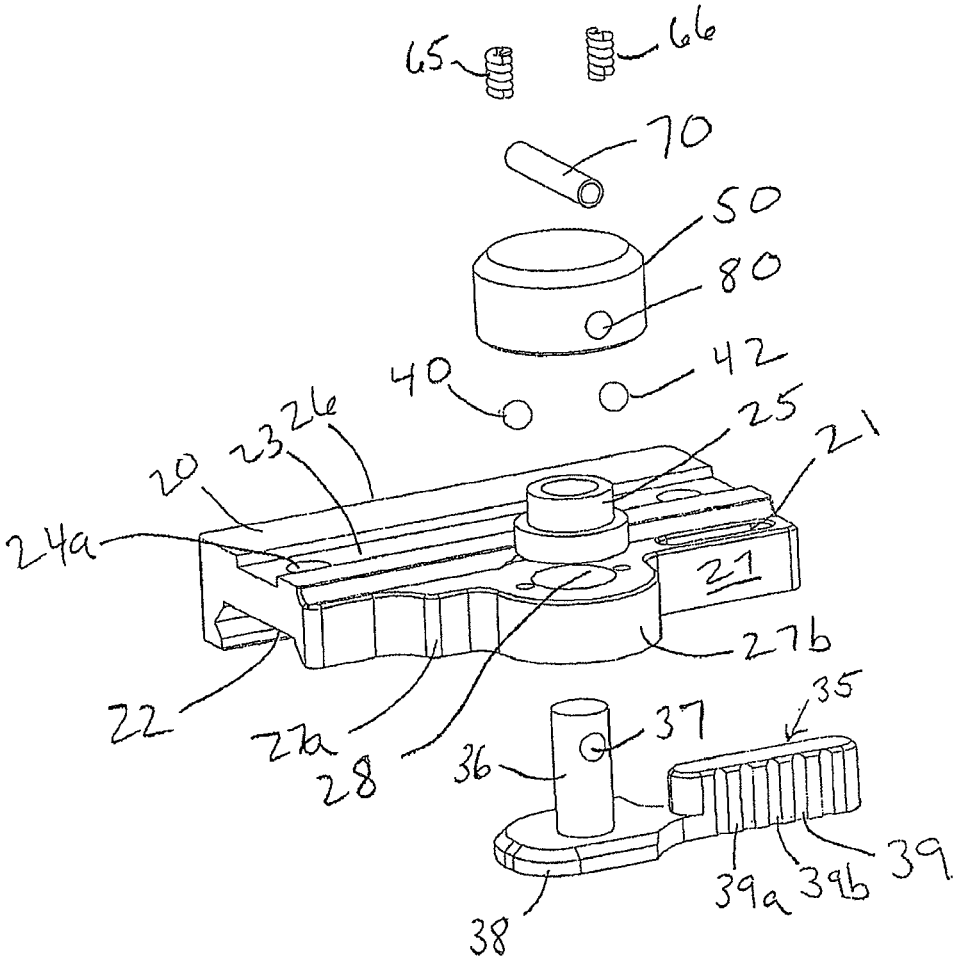
FIG. 3 is an exploded perspective top view of the device of FIG. 2B.
Figure 4:
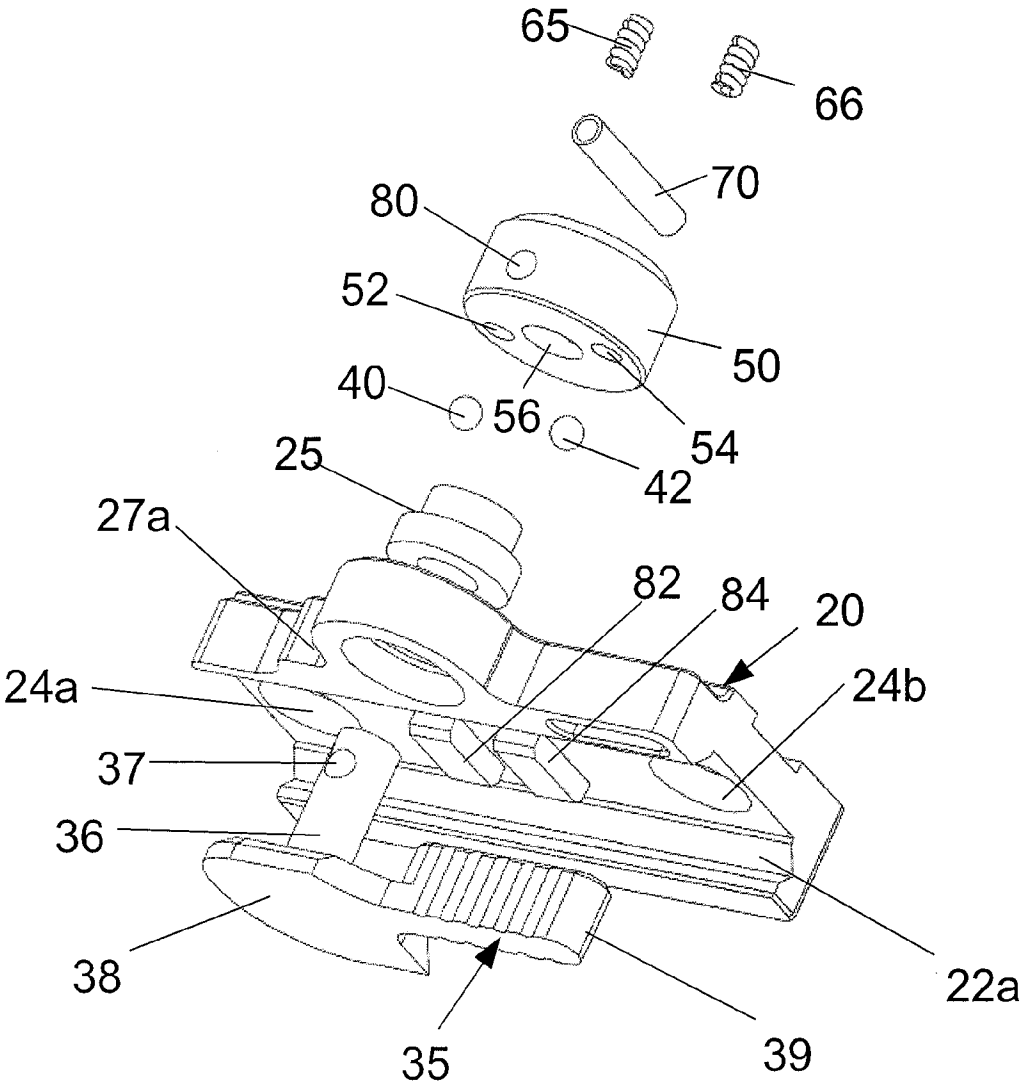
FIG. 4 is an exploded perspective bottom view of FIG. 3.

FIGS. 3 and 4 show an exploded view of device 10 of the present invention. The base 20 of the device 10 supports a washer 25, which is attached to a lever 35. Two bearings 40, 42 are operably connected to the washer 25 and the base 20. A fastening cap 50 mounts to the washer 25 on top of a shaft 36 on the lever 35. Two springs are provided in cavities 52, 54 in the fastening cap 50. The cavities 52, 54 receive springs 65, 66, which abut the bearings 40, 42. The springs 65, 66 provide a force to the bearings 40, 42, which pushes against the base 20. A hollow tube or pin roll fastener 70 fits into the cap 50 through a bore 80, which also travels through the shaft 36 and shaft bore 37 in the lever 35. Alternatively, another fastener (not shown) is provided to hold the now operably connected components in place.

FIG. 4 better shows the bottom or underside of the base 20. As shown in FIG. 4, the base 20 preferably includes a receiving groove 22*a* configured to receive a mounting rail. As also shown, on the bottom surface is a bottom first protrusion 82 and a bottom second protrusion 84. The protrusions are provided to be received into grooves in the rail when the quick release device 10 is mounted to the firearm.

Also shown in FIG. 4 is the fastening cap 50. As can be seen, a bottom side of the cap 50, preferably contains a multitude of receiving cavities. In the embodiment shown in FIG. 4, two cavities 52 and 54 are provided. A center bore 56 is provided which receives the shaft 36 of the lever arm 35.

Figure 5:
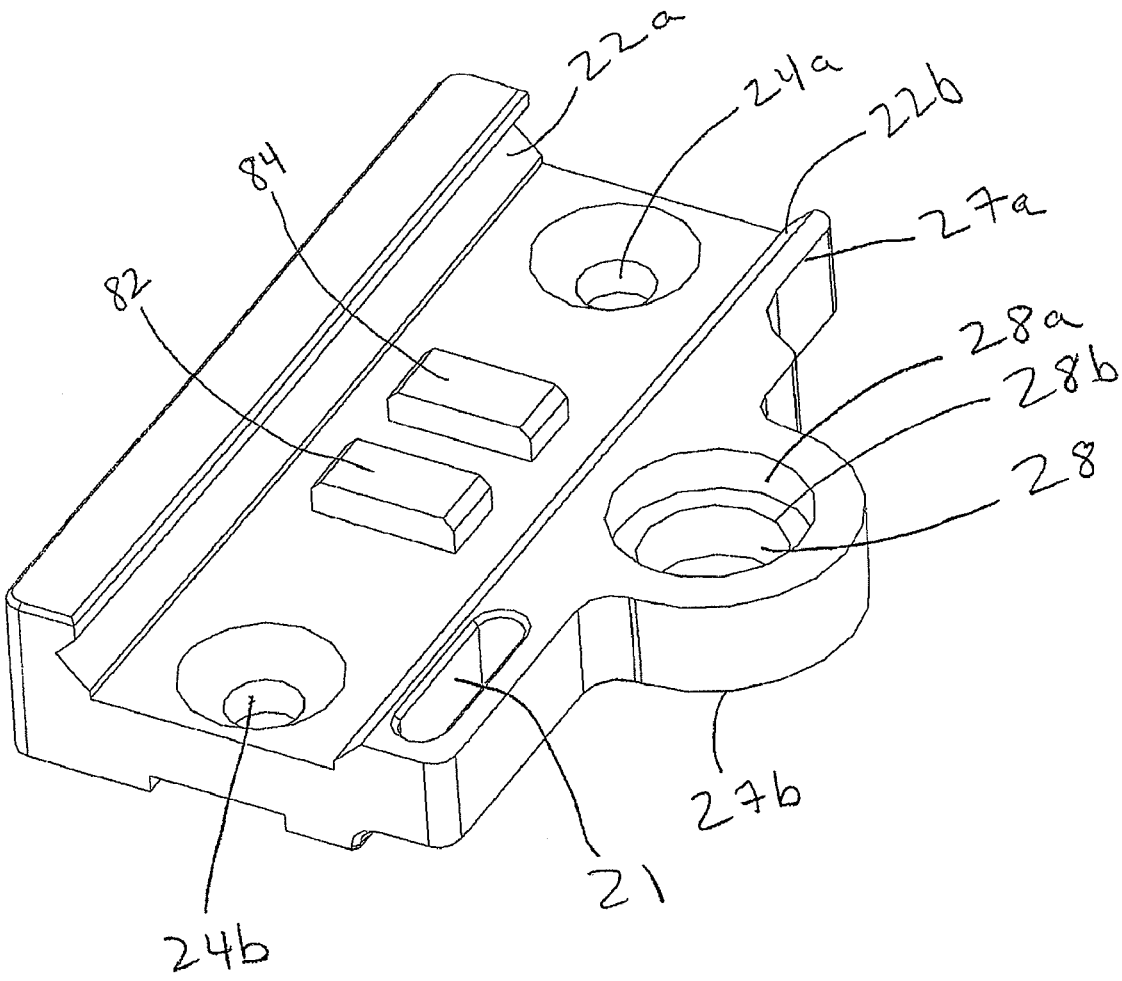
FIG. 5 is a perspective view of the base of the device of FIG. 3.

FIG. 5 shows in detail the base 20. As can also be seen, the mounting bores 24*a*, 24*b* of the base 20 may be countersunk. The orientation of the slot relative to the wall can also be better appreciated. Opposite the receiving groove 22*a* is an angled or sloping wall 22*b*. This wall 22*b* is provided to abut against the rail.

Figure 6:
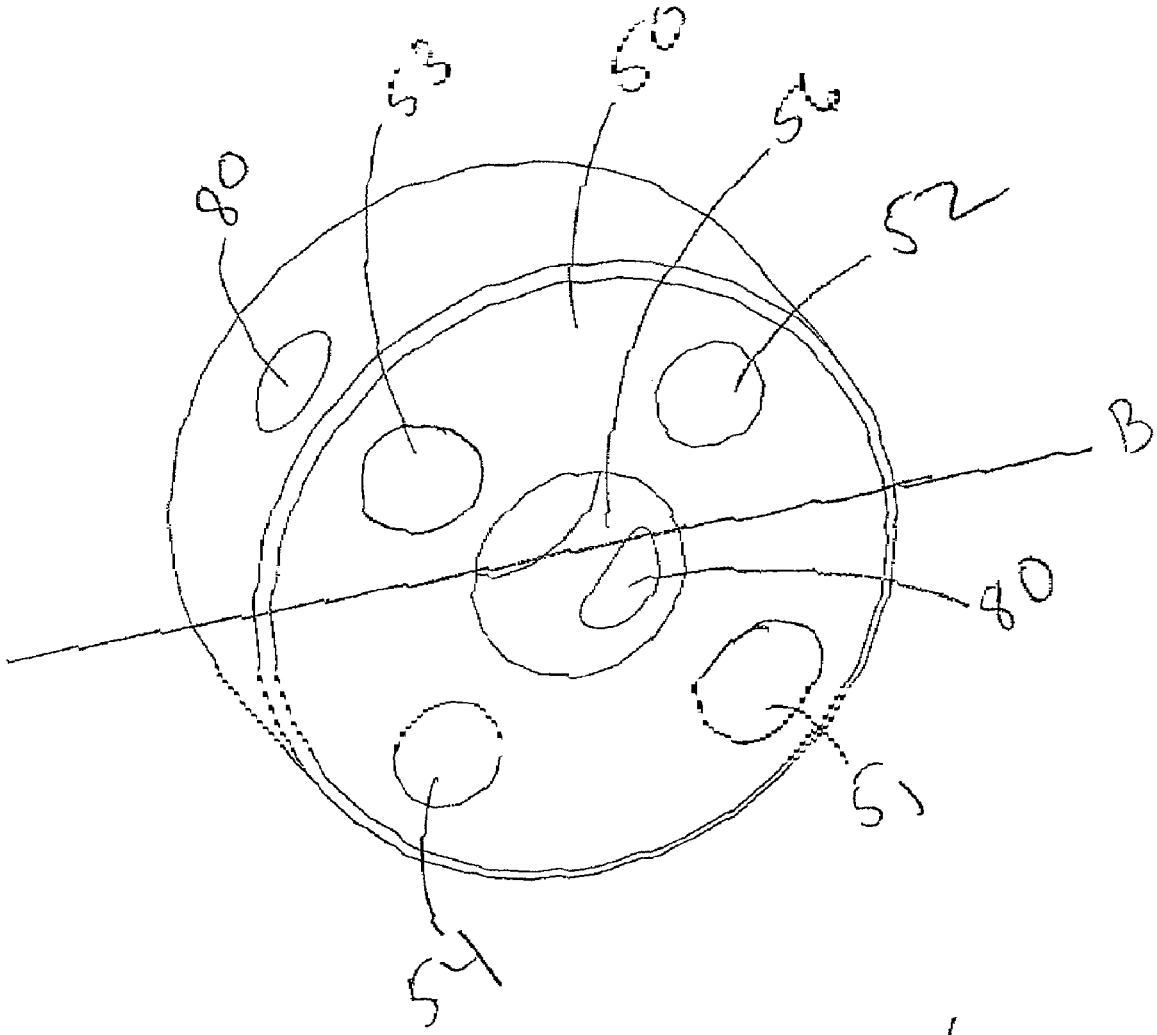
FIG. 6 is an alternative embodiment of the cap of the device of FIG. 3.

FIG. 6 shows an enlarged view of an alternative embodiment of the cap 50. In this embodiment, the cap 50 has four bearing receiving cavities 51, 52, 53, 54. As also is shown, the center bore 56 has an axis B and is surrounded by the receiving cavities. Perpendicular to the axis B is the fastening bore 80. The bore 80 passes through a first side of the cap 50, then through the center bore 56, and out a second side of the cap.

FIG. 7 is an enlarged view of the lever 35. As shown, the lever 35 preferably contains a cylindrical protrusion or mounting shaft 36 having a mounting hole 37. The mounting hole 37 receives the mounting tube 70 as it passes through hole 80 in the cap 50. The mounting tube 70 is preferably a threaded hollow Allen screw. The shaft 37 is preferably mounted to a flat piece of metal that is a stand 38 having a gradually sloping upper wall. Protruding from the stand is the arm 39. The arm 39 may have a multitude of lands 39*a* and grooves 39*b* machined or otherwise formed in a front and back surface of the arm. These lands and grooves provide an improved gripping surface for the operator.

When in use and operation, the base 20 of the present embodiment fits on a rail 3 attached to a gun 1. The device 10 is most often used to attach an accessory 18 to the gun such as a handle, night scope, light, additional weaponry, etc. Such an accessory 18 would be mounted to the top side of the base 20 on the barrel 16 or top side of the firearm 1. The bottom side of the base 20 preferably includes a receiving cavity 22 so that the base 20 can be received on the rail 3. When attaching the accessory 18 and the device 10 to the rail, the operator sets the receiving cavity 22 of the base on the rail. The lever arm 35 is then moved in a direction to effectively lock the base 20 to the rail. One key advantage is that the springs 65, 66 and bearings 40, 42 automatically adjust the device 10 for a snug fit to the rail. This is true even if different rails on different weapons are used by the operator for the same accessory. Of course, the size and shape of the rail cannot differ significantly, but must be within the required Milspec tolerances. Once the accessory 18 and a device 10 are locked in place, the operator has a greater sense of security that the accessory will not be accidentally lost. The tension or slight outward pressure applied by the ball bearings 40, 42 and the springs 65, 66 to the locking mechanism on the lever arm also helps prevent damage to the soft, but lightweight, metals typically used for the rail such as aluminum and other alloys. For example, where tolerances are very tight on prior art lever arms, the locking mechanism on such lever arms actually cuts into the rail making grooves or dents into it.

Now turning to FIGS. 8-17, and initially to FIGS. 8-13, another embodiment of the device 110 of the present invention includes a base 120 configured to receive a rail 3 of a receiver 2 attached to the barrel 16 of a firearm (not shown here). The bottom side of base 120 including a receiving cavity 122 which includes a receiving cavity groove 122*a* (See e.g., FIGS. 10 and 11). A top side of base 120 includes a slot or groove 123 running along a length thereof. The base also includes mounting bores 124*a* and 124*b*. The bottom side of base 120 further includes a pair of protrusions 125*a* and 125*b*. Along one edge of the base 120 is a first wall 126 which is generally straight. Opposite first wall 126 is the second wall 127 having a pair of recesses 128*a* and 128*b* configured to receive springs therein. Base 120 further includes a bore 130 running across the width thereof. Bore 130 is configured to receive a yoke 132 therethrough. First wall 126 includes a recess 134 for receiving the head 136 of yoke 132. Second wall 127 includes a hole 138 for receiving a threaded portion 140 of yoke 132.

Figure 14:
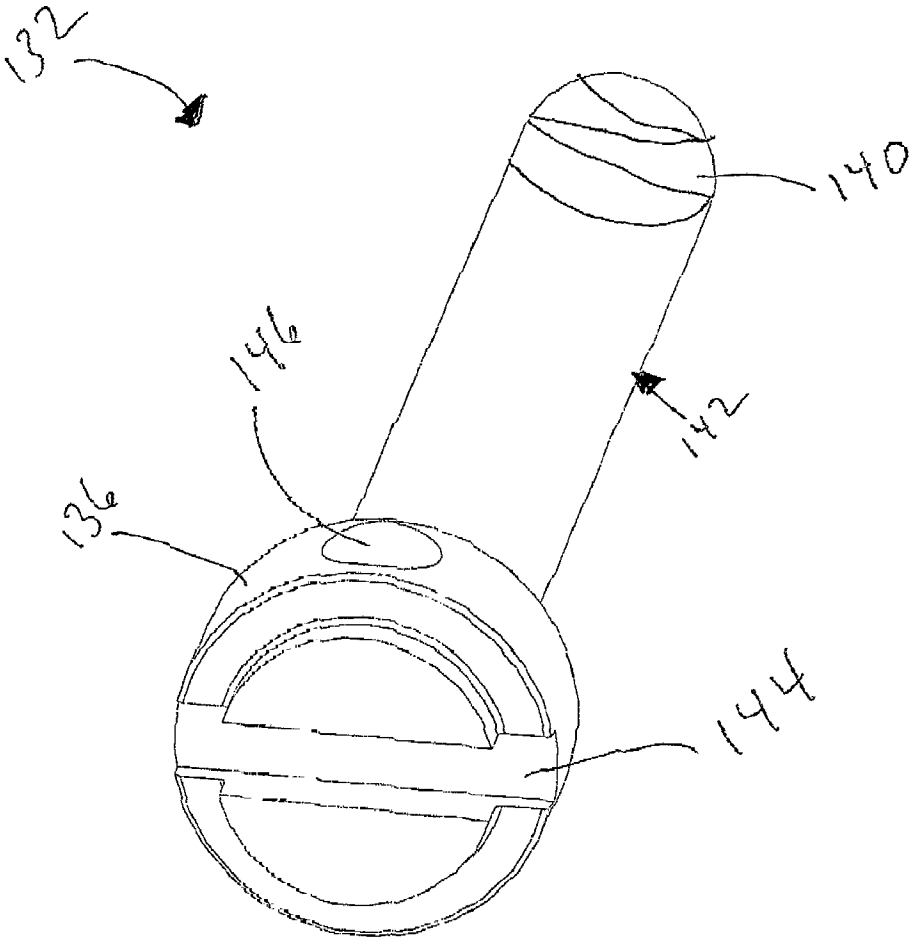
FIG. 14 is a perspective view of the yoke of the embodiment illustrated in FIG. 8.

Referring now to FIG. 14, yoke 132 is generally a connecting rod, rod or axle comprising a head 136 and a partially threaded shaft 142 having a threaded portion 140. Head 136 includes a slot or notch 144 running across the top surface thereof for receiving a tool such as, for example, a screwdriver. Head 136 further includes a bore 146 running through the center thereof. Bore 146 is configured to receiving a spring 147 therethrough and a pair of ball bearings 148*a* and 148*b* (see FIG. 9) are configured to be retained in the ends of bore 146. Further, the recess 134 of first wall 126 includes a series of detents 149 (see FIG. 12). The detents 149 are generally configured to contact portions of ball bearings 148*a* and 148*b* such that when yoke 132 is rotated, the ball bearings 148*a* and 148*b* coming into contact with detents 149 give the user audible and tactile feedback as to the relative position of yoke 132 as it is advanced or withdrawn.

Figure 15:
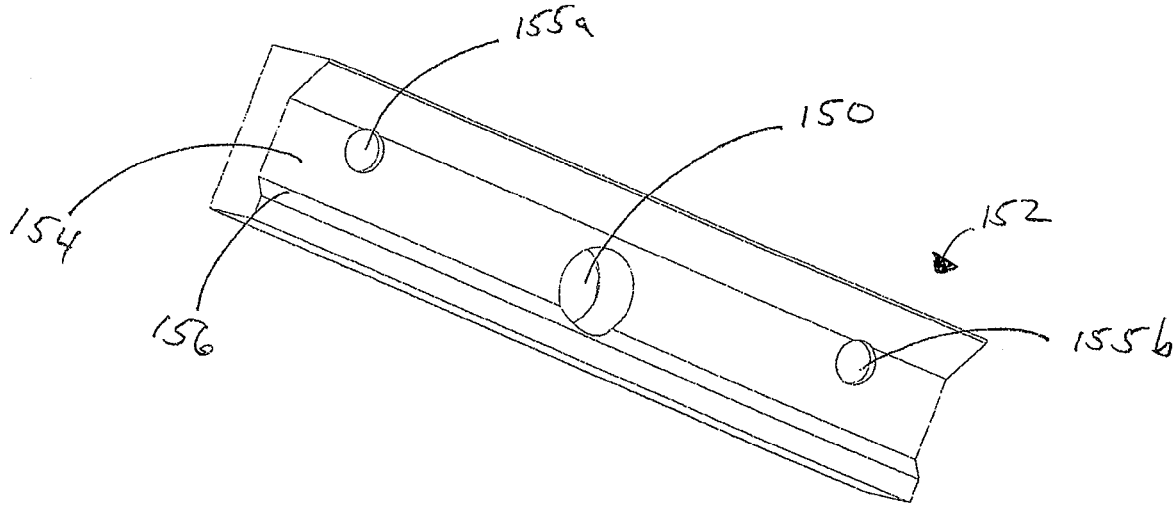
FIG. 15 is a perspective view of the frame member of the embodiment illustrated in FIG. 8.

Turning now to FIG. 15, the threaded portion 140 of yoke 132 is configured to be received through a centrally positioned bore 150 in a frame member 152 such that an end of the threaded portion 140 extends past the frame 152. Yoke 132 is thus configured to draw base 120 and frame 152 together. Base 120 and frame 152 are generally spring-biased with respect to one another by springs retained by recesses 128*a* and 128*b* of second wall 127 (see FIG. 13). A bottom surface of frame 152 defines a receiving cavity 154 having a receiving groove 156 for receiving a portion of a rail 3 of a receiver 2 attached to the barrel 16 of a firearm 1 therein. Frame 152 further includes a pair of recesses 155*a* and 155*b* configured to receive springs therein.

Referring again to FIG. 9, the end of yoke 132 is received by a threaded receiving portion 158 of a cam member 160. Threaded receiving portion 158 generally extends upwardly from the generally circular cam member 160. Cam member 160 includes a notch 162 on an outer surface thereof. Cam member 160 further includes a bore 164 through the center thereof. Bore 164 is configured to receive a dowel pin 166 or the like. Accordingly, as yoke 132 is advanced so as to bring base 120 and frame 152 closer to one another, the end of threaded portion 140 of yoke 132 eventually comes into contact with dowel pin 166 thereby limiting the advancement thereof.

Figure 16:
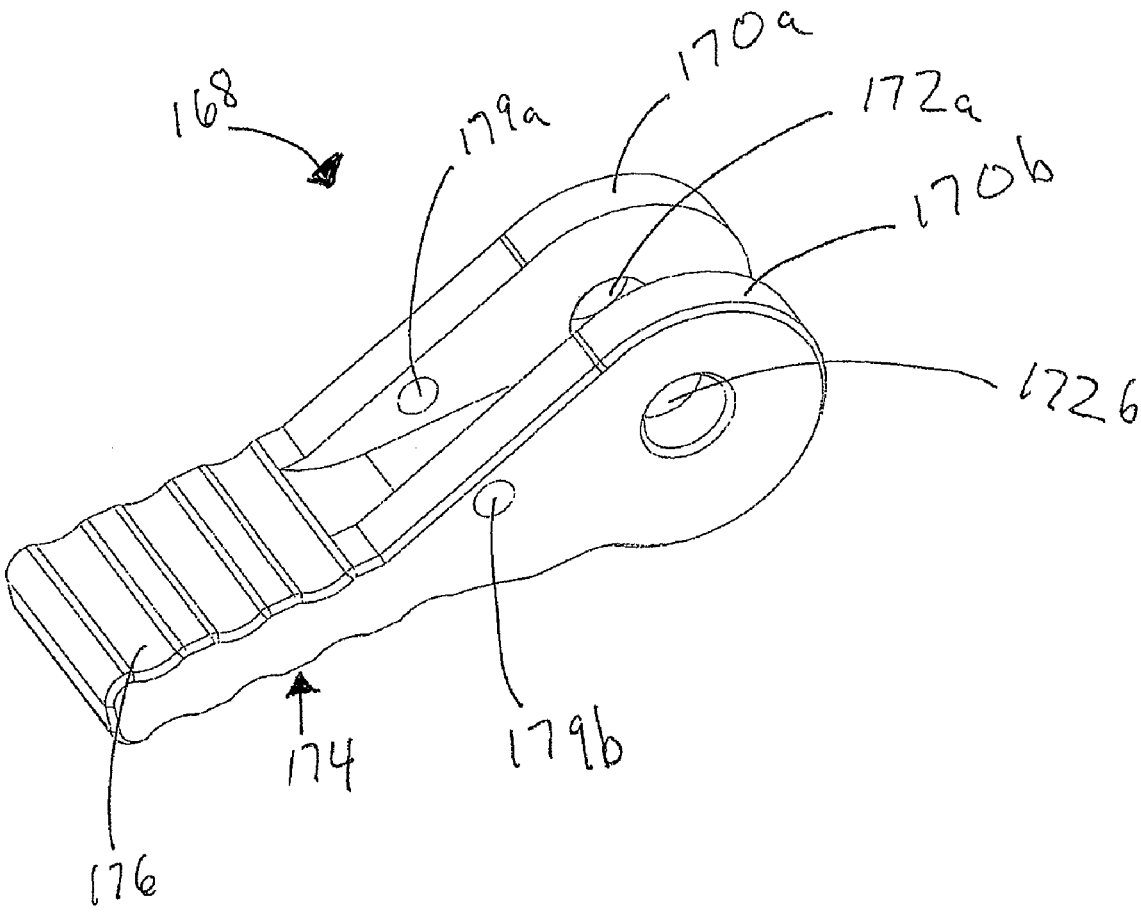
FIG. 16 is a side perspective view of the lever of the embodiment illustrated in FIG. 8.
Figure 17:
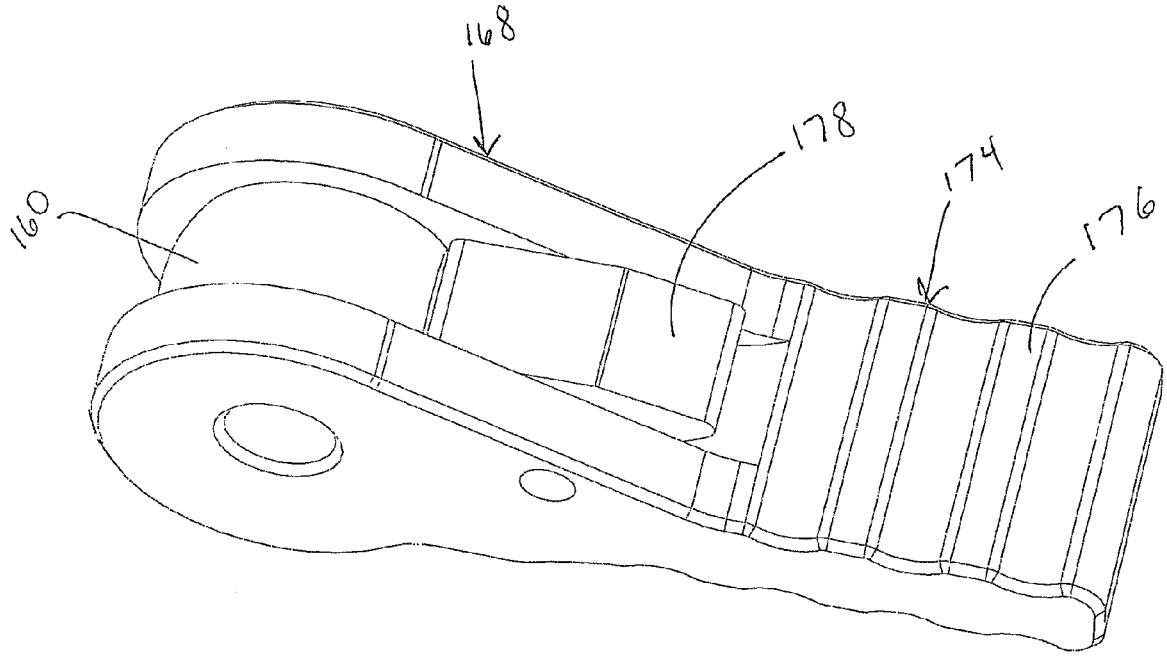
FIG. 17 is a top perspective view of the locking mechanism of the embodiment illustrated in FIG. 8.

Referring now to FIGS. 16 and 17, cam member 160 is coupled to a lever 168 having two opposing side surfaces 170*a* and 170*b* configured to receive cam member 160 therebetween. Further, the opposing side surfaces 170*a* and 170*b* include apertures 172*a* and 172*b* for receiving ends of dowel pin 166 therein. Extending from opposing side surfaces 170*a* and 170*b* is an arm 174. The arm 174 preferably includes grooves 176 that add a textured surface to the arm 174 to allow for better gripping of the lever arm 174 by the operator in the field.

Operably coupled to the lever 168 is a button 178 which is spring biased with respect to the lever arm 174 by a spring 180. Button 178 may be secured in place by a pin or the like running through a width thereof through apertures 179*a* and 179*b*. Button 178 is configured such that an end portion thereof is selectively and removably retained by the notch 162 (see FIG. 9). Accordingly, when an end of button 178 is retained in notch 162 of cam 160, the base 120 and frame 152 become locked with respect to one another. Alternatively, when adjustment of the width of base 120 and frame 152 is desired, the button 178 may be depressed such that it may be removed from notch 162 thereby allowing the arm 174 of lever 168 to swing to the opposite side thereof, thereby freeing base 120 and frame 152 to move horizontally with respect to one another. This allows the width of device 110 of the present embodiment to be adjusted to accommodate varying rail sizes. The presence of button 178 is useful in preventing accidental loosening of the device 110 in the field. Further, the lever 174 configured to allow for ambidextrous operation as the lever 174 may be rotated 180 degrees and adjusted for the particular firearm.

The width of device 110 is adjusted by turning yoke 132 to draw base 120 and frame 152 closer to one another or to separate base 120 and frame 152 from each other. Preferably, the device 110 of the present invention comprises eight different predetermined positions. The tactile and audible feedback generated by the contacting of ball bearings 148*a* and 148*b* and detents 149 alerts the user to the relative position of the device 110. Preferably, this embodiment of the present invention provides a user with significant adjustability. Further, the present embodiment provides even pressure distribution between the device 110 and rail 3 thereby limiting the marring of the rail 3 often created by poor-fitting connections.

Turning now to FIG. 18-21, the device 110 of the present invention is shown coupled to a rail 3 and having an accessory mount 182 attached thereto. When in use and operation, the base 120 of the present embodiment fits on a rail 3 attached to a firearm 1. The device 110 is most often used to attach an accessory 18 to the firearm 1 such as a handle, night scope, light, additional weaponry, etc. Such an accessory 18 would be mounted to the top side of the base 120 on the barrel 16 or top side of the firearm 1. The bottom side of the base 120 preferably includes a receiving cavity 122 (see FIG. 10) so that the base 120 can be received on the rail 3. When attaching the accessory 18 and the device 110 to the rail, the operator sets the receiving cavity 122 of the base 120 on the rail 3. The lever arm 174 (see FIG. 9) is then moved in a direction to move the base 120 and frame 152 together to effectively clamp and lock the base 120 to the rail 3.

Figure 18:
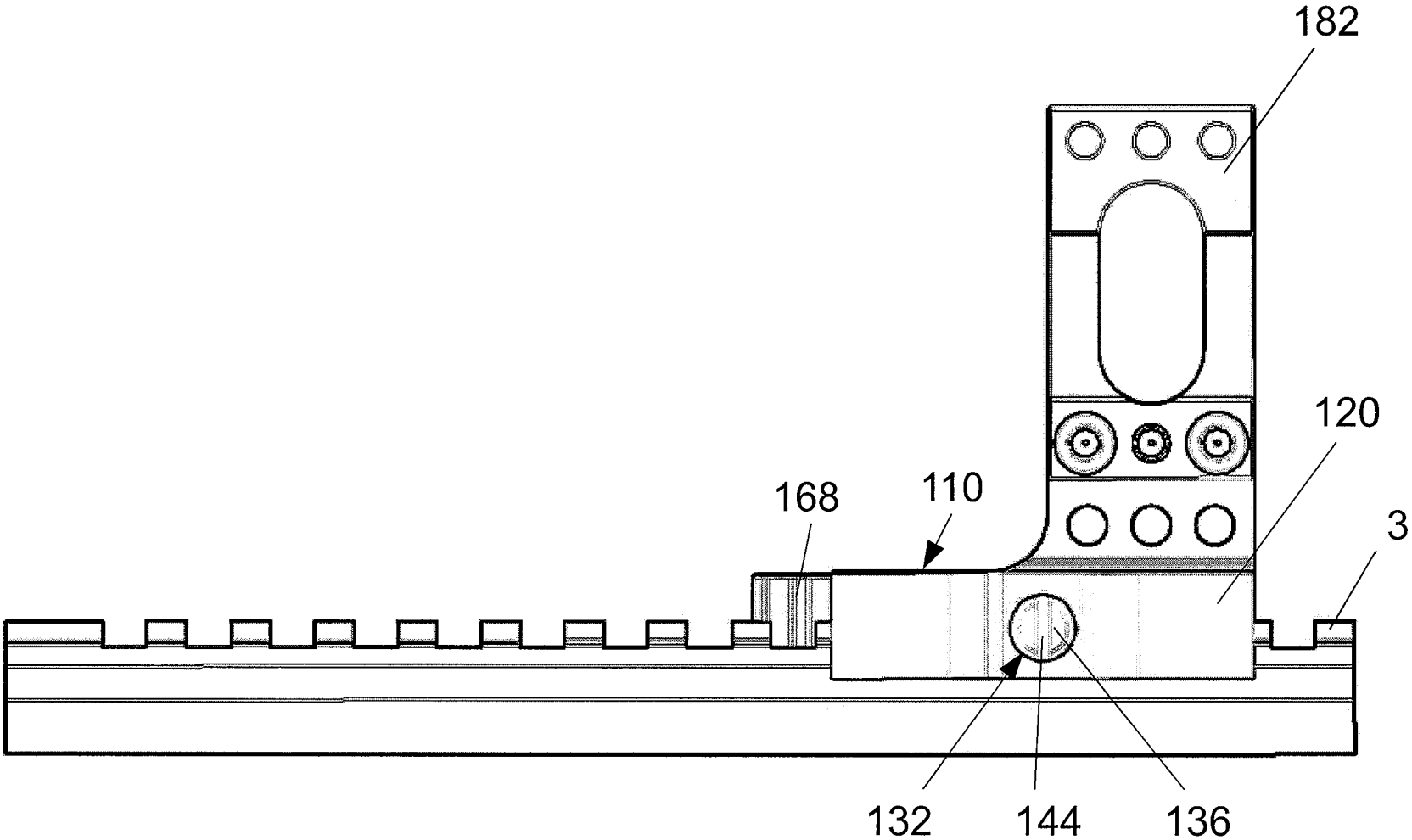
FIG. 18 is a side view of the device of the present invention mounted to a firearm rail and having an accessory mount attached thereto.
Figure 19:
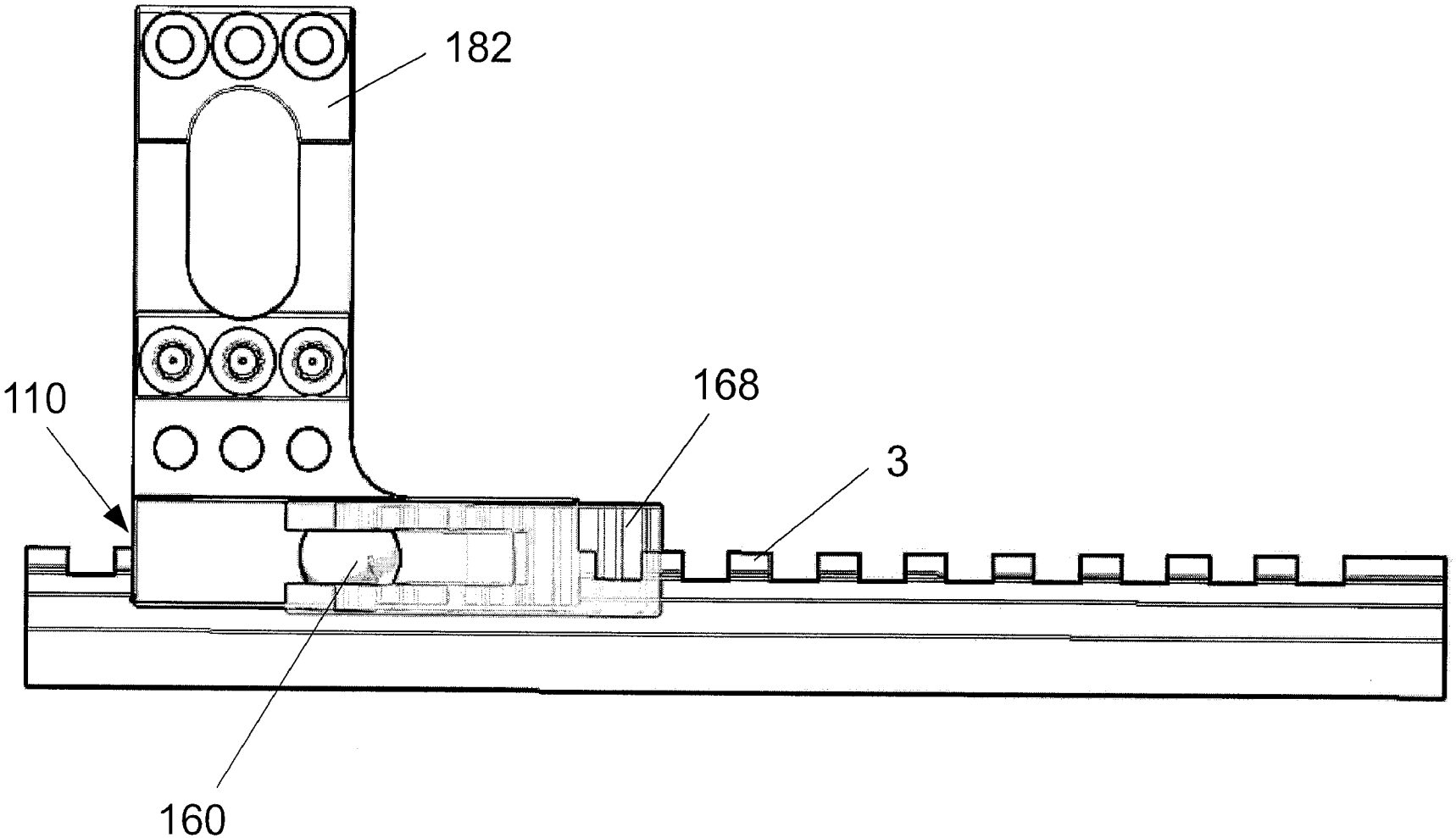
FIG. 19 is a side view of the device of FIG. 18 shown from the opposite side.

Now referring to FIGS. 18 and 19, the device 110 of the present invention is shown coupled to rail 3. The bottom side of base 120 is secured around rail 3 and locked into place by way of the cam 160 and yoke 132 mechanism, as described previously. Accessory mount 182 is coupled to an upper surface of base 120 and secured in slot groove (not shown) by way of screws or other such fasteners via mounting bores (not shown).

Figure 20:
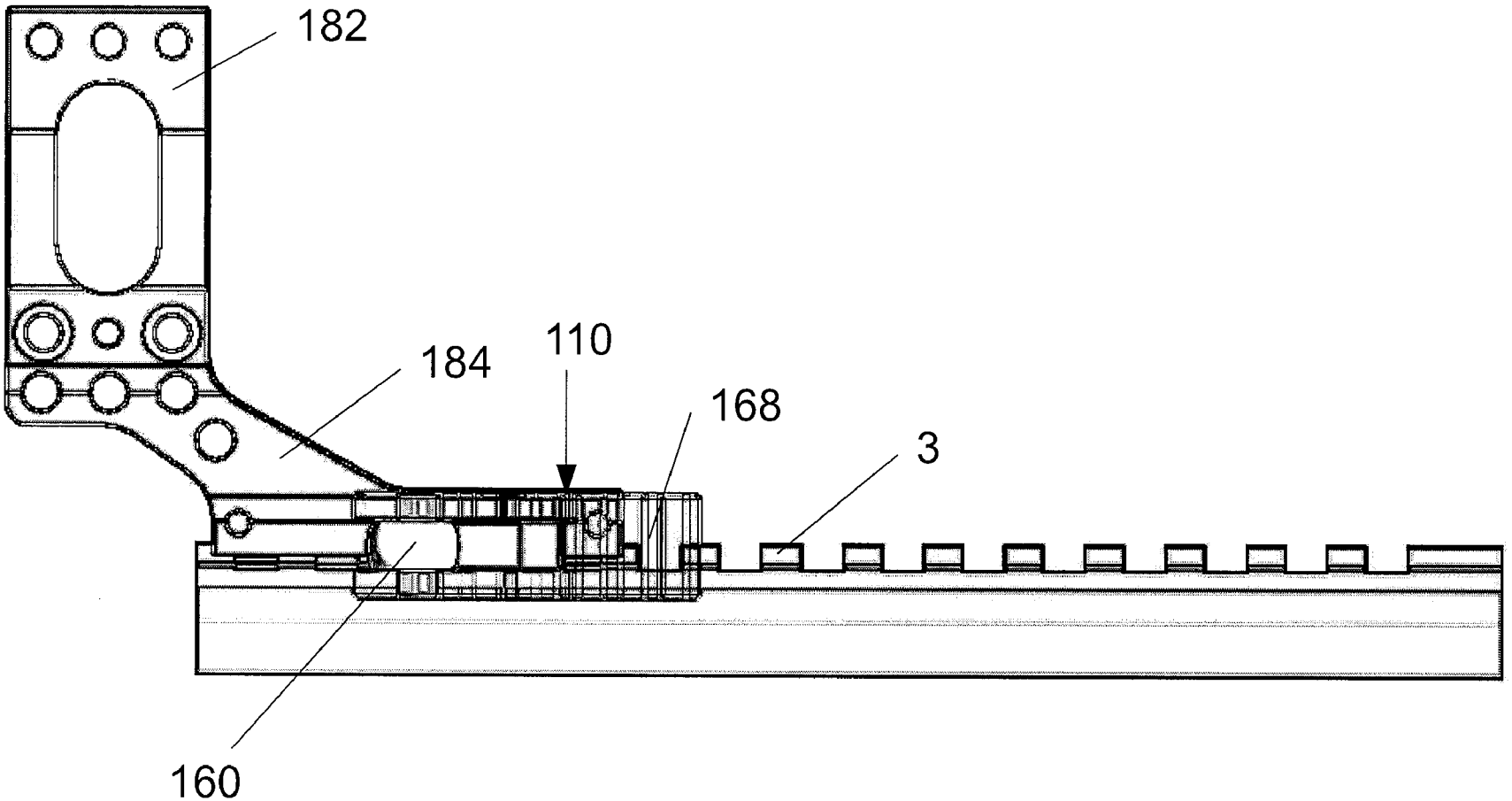
FIG. 20 is a side view of the device of the present invention having an extendible accessory mounted thereto.

Turning now to FIG. 20 an alternative embodiment is shown wherein accessory mount 182 comprises an extendible arm 184 for selectively positioning the accessory to be mounted to device 110.

Figure 21:
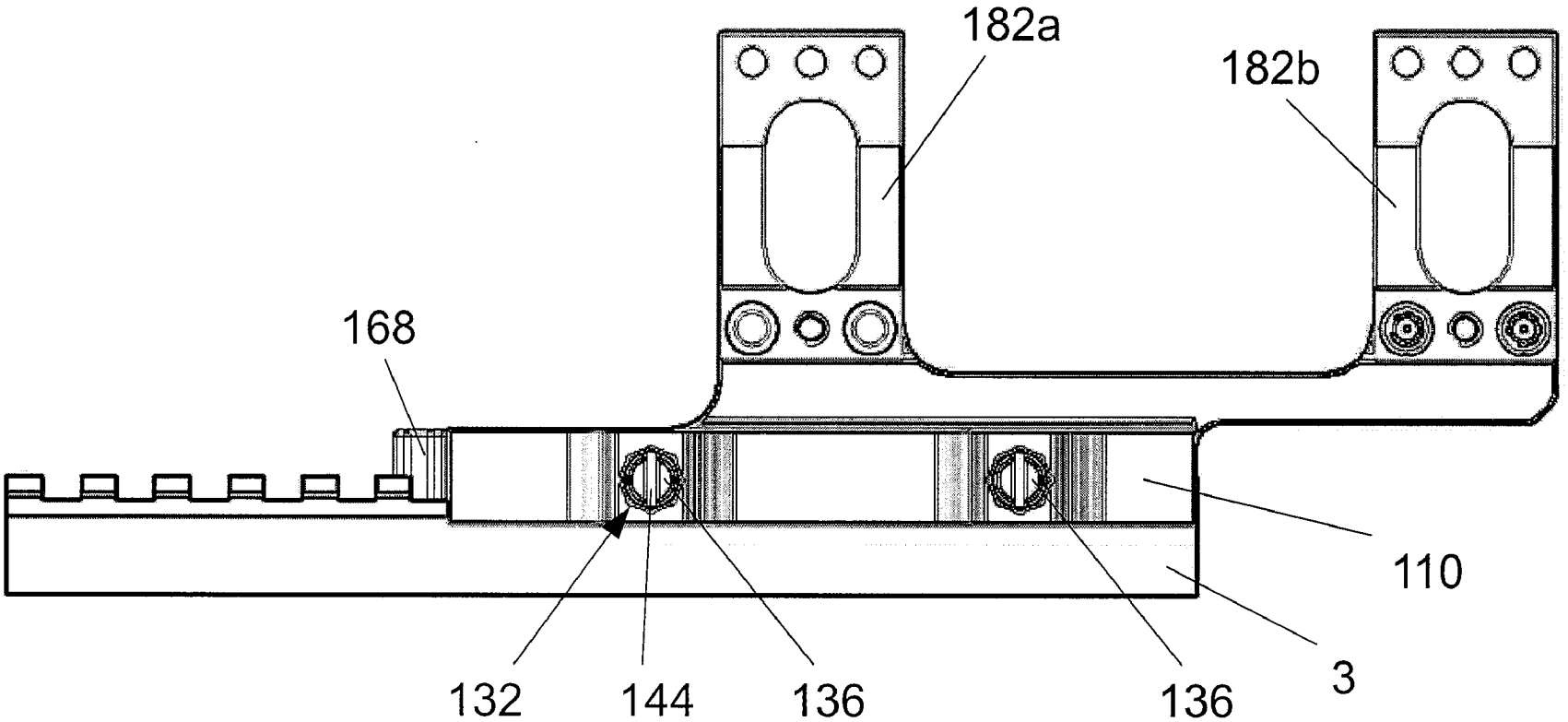
FIG. 21 is a side view of another embodiment of the device of the present invention mounted to a firearm rail and having an accessory mount attached thereto.

Referring to FIG. 21, yet another embodiment is shown wherein two devices 110 of the present invention are coupled to rail 3 to accommodate the mounting of an elongated accessory mount 182*a* and 182*b*. Preferably, the present invention may be modified to accommodate a plurality of different accessories mounted thereto.

Figure 22:
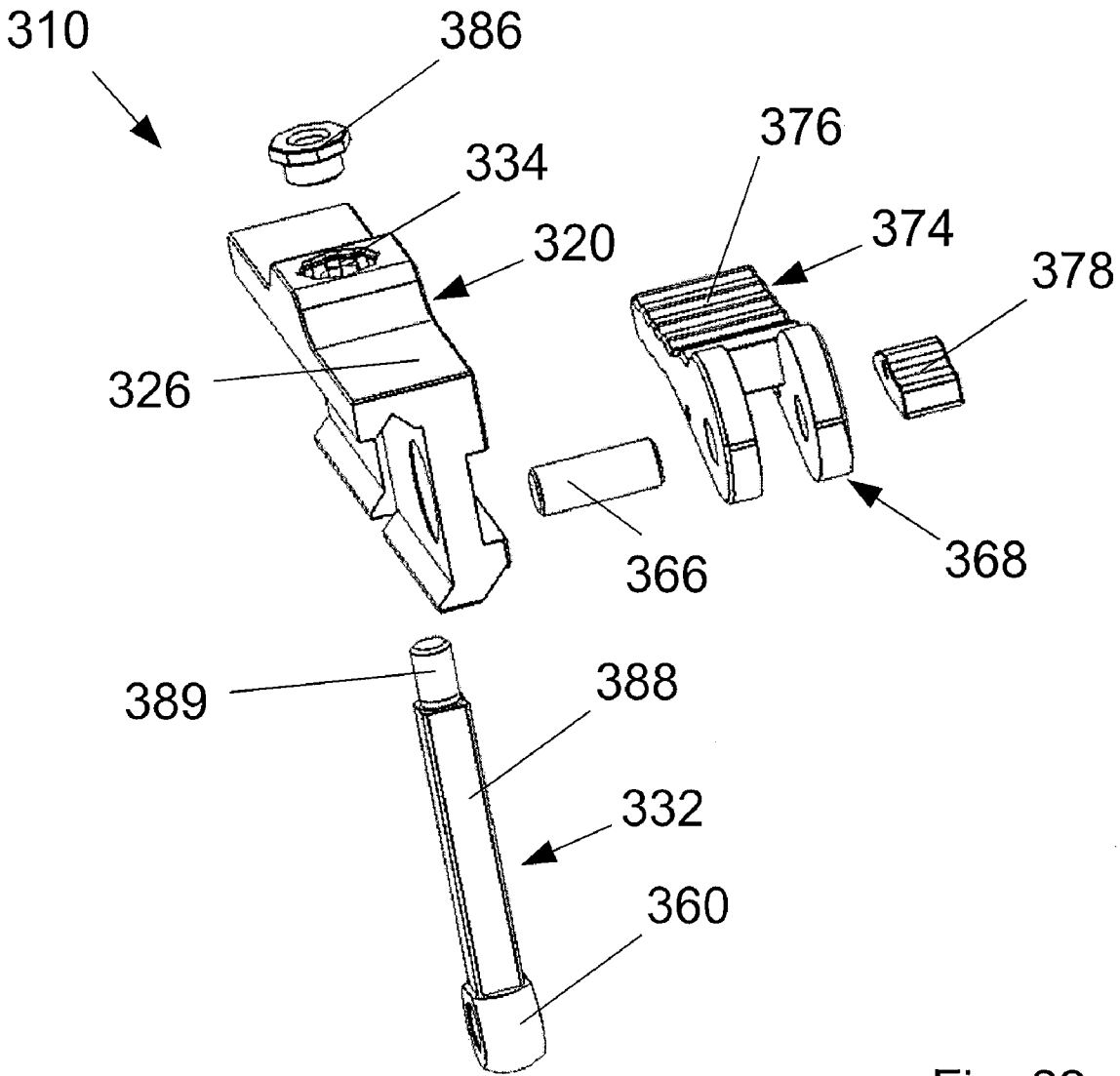
FIG. 22 is a perspective view of a portion of another embodiment of the mount of the present invention.
Figure 23:
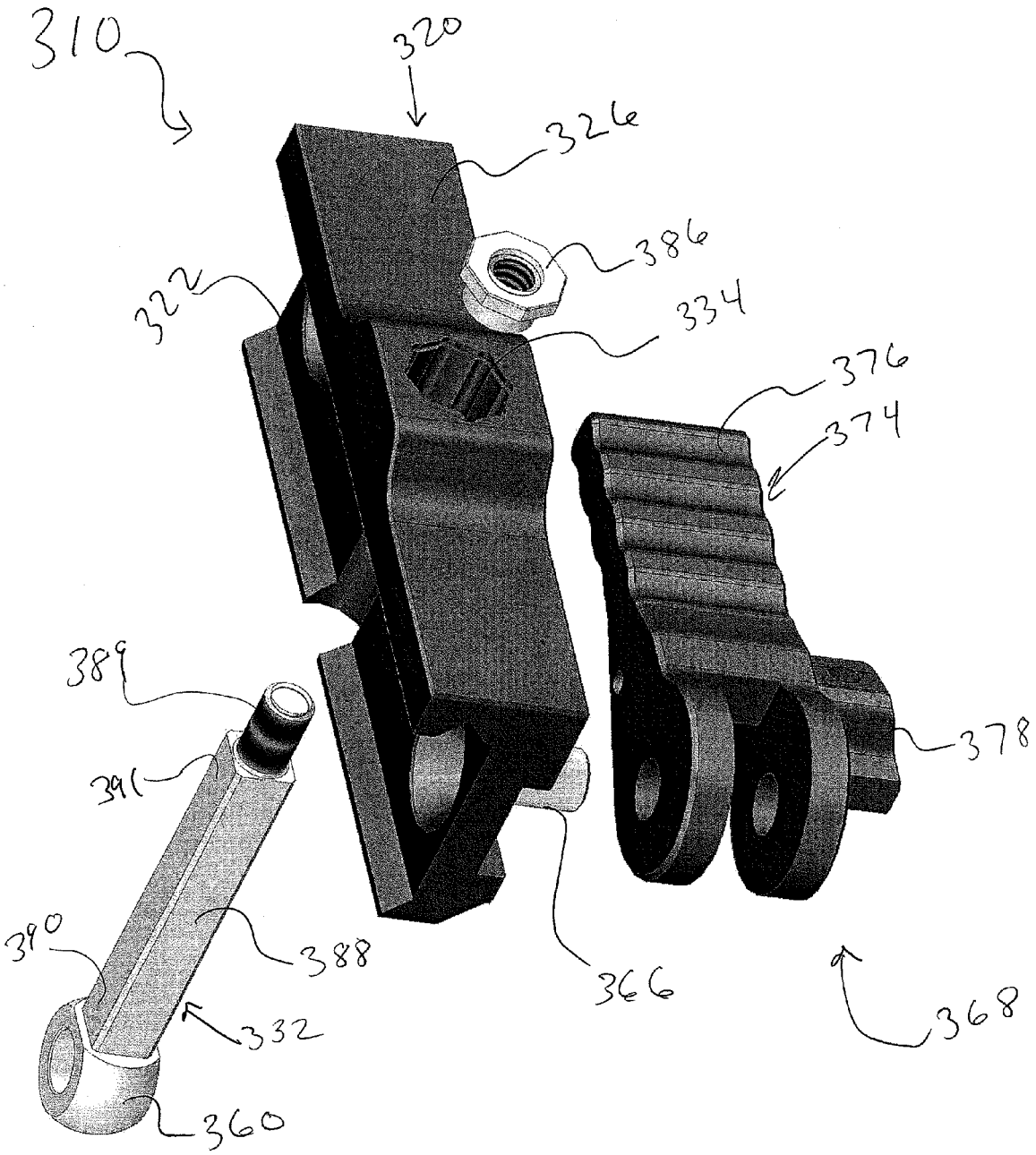
FIG. 23 is a perspective view of the device of FIG. 22 shown from another side.
Figure 24:
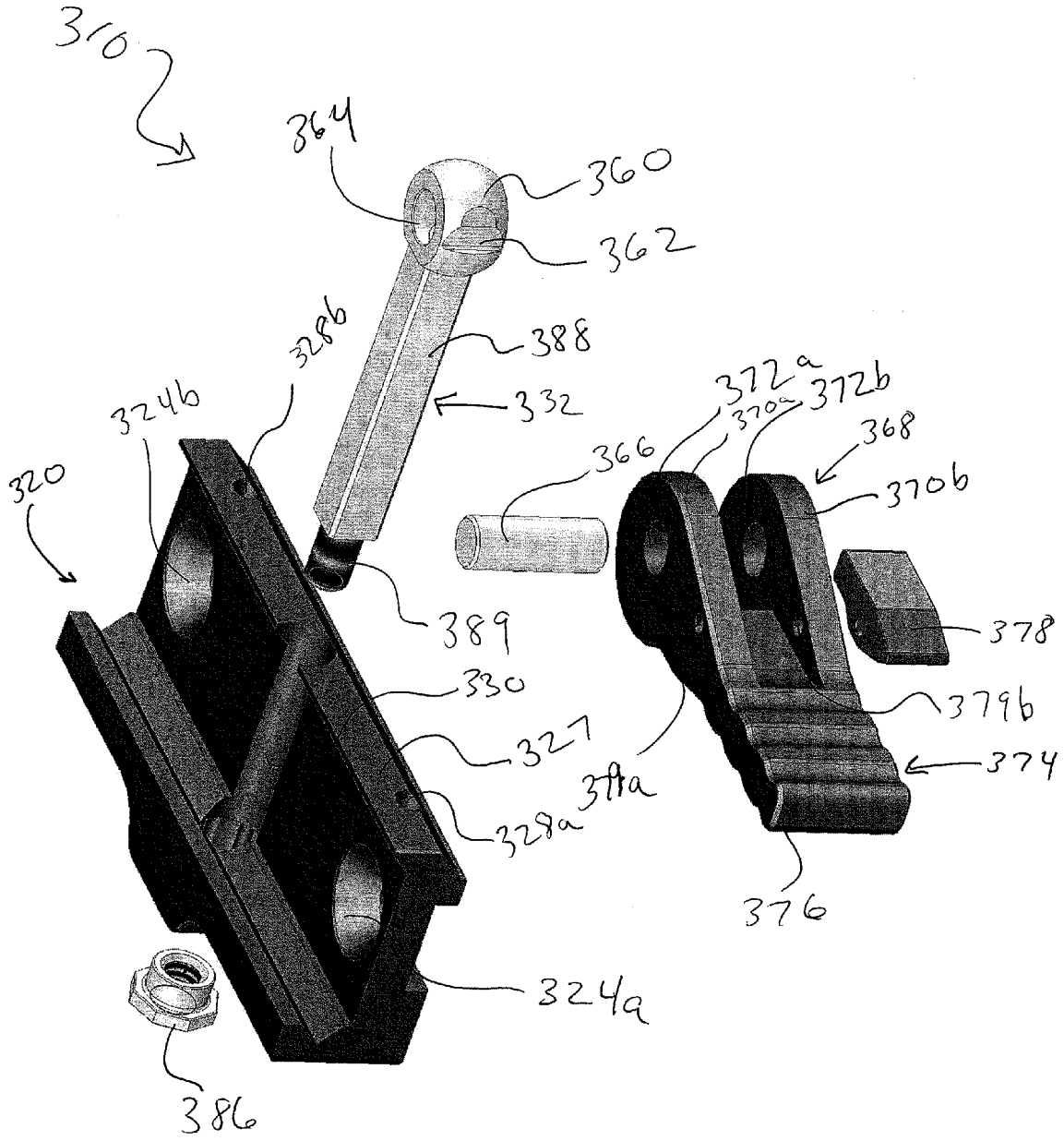
FIG. 24 is a perspective view of the device of FIGS. 21-22 shown from another side thereof.

Turning now to FIGS. 22-24, another embodiment of the device 310 of the present invention includes a base 320 configured to receive a rail of a firearm. The bottom side of base 320 includes a receiving cavity 322 configured to receive the rail therebetween. The base further includes a pair of mounting bores 324*a*, 324*b*. Along one edge of base 320 is a first wall 326 which is substantially straight. Opposite first wall 326 is a second wall 327 having a pair of recesses 328*a*, 328*b* configured to receive compression members such as springs therein. Base 320 may further include a pair of protrusions (not shown) similar to protrusions 82, 84 of a prior embodiment of the present invention. Base 320 further includes a bore 330 running across its width and configured to receive a yoke 332 therethrough.

Yoke 332 may comprise either a one-piece or two-piece yoke. The two-piece yoke embodiment, 332, may comprise an outer rod 388 which houses an inner rod 389. Outer rod 388 is preferably a steel squared shaft. Outer rod 388 comprises lower end 390 and upper end 391 from which inner rod 389 extends. Inner rod 389 is preferably threaded and has a first end configured to be received by threaded receiving portion (not shown) of cam 360, and a second end is configured to be received by a locking nut 386. Alternatively, the rod may be a single rod with threaded portions. In one embodiment, the rod is configured to replace the protrusions (e.g., 82, 84) and fit into grooves or notches 26 in the rail 3 (not shown here).

Nut 386 preferably comprises an internally threaded receiving nut having a centrally located opening running through the center thereof for receiving the threaded inner rod 389. Nut 386 is preferably beveled so as to be received by a generally frustoconically shaped recess 334 located in the first wall 326 of base 320. The frustoconical shape of nut 386 provides for better force distribution to yoke 332 and nut 386, thereby preventing sheering. Nut 386 may be secured by hand, or alternatively, it may have a slot on an upper surface for receiving a screwdriver or similar such tool.

Yoke 332 is preferably a connecting rod or similar such connector and couples base 320 to a frame member (not shown) that is spring biased with respect to base 320, as in the previous embodiments of the device 310. The frame member of the present embodiment may comprise a frame similar to those of the previous embodiments. Yoke 332 is configured to selectively adjust the width of the device 310 by advancing the threaded inner rod 389 toward side 326 of base 320 to draw the base 320 and frame member closer to one another or, alternatively, extending the distance between the base 320 and the frame member by advancing the yoke toward side 327 of base 320.

Cam 360 includes a notch 362 on its outer and a bore 364 extending through the center thereof. Bore 364 of cam 360 is configured to receive a dowel pin 366 or similar such connector. Cam member 360 is coupled to a lever 368 having two opposing sides 370*a*, 370*b* that are configured to receive cam member 360 therebetween. Sides 370*a*, 370*b* further include apertures 372*a*, 372*b* configured to receive the ends of dowel pin 366. An arm 374 extends from the sides 370*a*, 370*b*. Arm 374 includes grooves 376 over the surface thereof. Grooves 376 are configured to provide the user with a textured surface to allow for improved gripping of the lever arm 374 during operation.

A button 378 is coupled to lever 368 and spring biased with respect thereto by a spring or other such compression member (not shown). Button 378 may be secured in place by a pin or other such connector running through a pair of apertures 379*a*, 379*b* disposed in the sides 370*a*, 370*b* respectively. Button 378 is configured such that an end portion of button 378 is selectively and removably retained in the notch 362 of cam 360. Accordingly, when the end of button 378 is retained in notch 362 of cam 360, the base 320 and frame member become locked with respect to one another. The button 378 may be selectively removed from notch 362 of cam 360 by depressing the button 378 to thereby free the base 320 with respect to the frame member. Accordingly, the width of the base 320 and frame member may be selectively adjusted by advancing yoke 332 in a particular direction to accommodate rails of varying size.

The width of device 310 is adjusted by turning yoke 332 to draw base 320 and the frame member closer to one another or to separate them from each other. The device 310 of the present embodiment preferably comprises a plurality of different predetermined positions thereby allowing the device 310 to accommodate a wide variety of rail types. Preferably, the device 310 of the present embodiment is configured such that the selection of the predetermined positions is done without audible feedback, thereby allowing a user to advance on a target and adjust a sight or other such device without alerting the target.

The device 310 of the present invention may be configured to receive a Tangodown™ grip handle, or other similar device. A Tangodown™ handle may be amounted on any accessory rail. The Tangodown™ handle has an H-shaped cavity configured for receiving protrusions of base 320. The Tangodown™ handle may then be secured with locking bolt disposed between the protrusions of base 320 and configured to be secured to the center of the handle. The base may be rounded to better conform to the shape of the grip and to eliminate sharp edges.

The devices 10, 110, and 310 and its components are typically fabricated from a relatively strong, lightweight material such as, for example, aluminum. For example, the devices 10, 110, and 310 of the present invention may be constructed from 6061 anodized aluminum hardcoat or 17-4 stainless steel. It is possible, however, to construct devices 10, 110, and 310 from other such materials including both metals and plastics having similar characteristics. Further, the devices 10, 110, and 310 are fully adjustable so as to fit rails 3 of varying size as well as those that have become worn as they comprise a relatively large contact area without causing damage thereto.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape, and assembled in virtually any configuration. Further, although many components described herein are physically separate modules, it will be manifest that they may be integrated into an associated component. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

What is claimed is:

1. A mount configured to receive a rail of a firearm and for attaching an accessory thereto, comprising:

a mounting structure comprising a first wall; and a base defining a cavity for receiving the rail and defining a second wall, the base biased with respect to the first wall by at least one compressible member;

a yoke for coupling the base to the first wall and including a cam member having a notch on a surface thereof and extending through the first wall, wherein a portion of the yoke is retained within a groove disposed in the cavity;

a nut for adjustably securing the yoke to the second wall;

a lever rotatably coupled to the cam member by a pin, wherein the lever is configured to rotate between at least a first position and a second position; and a button pivotably coupled to the lever and configured to matingly cooperate with the notch of the cam to secure the lever with respect to the cam member when the lever is rotated to one of the first position and the second position, wherein the button is depressible to rotate relative to the lever to allow the lever to rotate with respect to the cam member.

2. A mount configured to receive a rail of a firearm and configured to receive an accessory, the mount comprising:

a two piece mounting structure comprising a base and a frame coupled to one another and having a bottom cavity for receiving the rail of the firearm;

a shaft assembly that extends laterally between the base and the frame;

a lever mechanism operably coupled to the shaft assembly on a side of the two piece mounting structure that is adjacent the frame and offset from the rail;

wherein the lever mechanism is pivotably connected to the shaft assembly by a pin that extends through the shaft and in a direction that is generally transverse to an axis of the shaft assembly, the lever mechanism being configured to adjustably define a distance between the base and the frame to accommodate the rail therebetween;

wherein the lever mechanism comprises, a lever arm having opposing sides that are eccentrically engaged with the pin and a button disposed on a surface therebetween;

a notch formed on a surface of a yoke received between the opposing sides of the lever arm; and wherein the button is configured to be selectively received by the notch thereby locking the base with respect to the frame.

3. The mount of claim 2 wherein the shaft assembly further comprises the yoke and the yoke is disposed between the base and the frame to couple the base and the frame to one another.

4. The mount of claim 3 wherein the base includes an aperture on a side thereof for receiving an end of the yoke.

5. The mount of claim 4 further comprising a nut disposed within the aperture configured to receive the end of the yoke therein and wherein the shaft assembly is toollessly rotatable relative to the nut to define a minimum distance between the base and the frame when the lever mechanism is closed.

6. A mounting device for mounting an accessory to a rail of a firearm comprising:

a base member having a rail receiving cavity formed in a rail facing side of the base member;

a first groove formed along the rail facing side of the base member to engage the rail;

a frame member having a rail facing side that also faces the base member;

an opening formed in the frame member;

a second groove formed along the rail facing side of the frame member, the second groove having a first wall that cooperates with the base member and a second wall that engages the rail;

a shaft extending between the base member and the frame and passing through the opening formed in the frame member;

a fastener that engages a first end of the shaft proximate the base member;

a lever assembly secured to a second end of the shaft and isolated from the receiving cavity by the frame member, the lever assembly including a lever that is pivotably attached to the shaft, the lever being rotatable relative to the frame between an open position and a closed position so as to alter a distance between the first groove and the second groove and the fastener being rotatable relative to the shaft so as to define a distance between the first groove and the second groove associated with the closed positioned of the lever;

a pin that secures the lever assembly to the shaft; and a lock that is pivotably connected to the lever and cooperates with a notch formed on the shaft to secure the lever in the closed position.

7. The mounting device of claim 6 further comprising a spring that biases the lock into the notch.

8. The mounting device of claim 6 further comprising at least one spring that biases that frame member toward the lever assembly and away from the base member.

9. The mounting device of claim 6 further comprising a projection that extends across the rail receiving cavity and that cooperates with a groove formed in the rail to define a position of the mounting device along a longitudinal length of the rail.

10. The mounting device of claim 9 wherein the projection is formed by the shaft.

11. A device for mounting to a rail of a firearm, the device configured to receive an accessory for mounting thereto, the device comprising:

a base member shaped to flank a top side and a first lateral side of the rail;

a frame configured to cooperate with the base member and a second lateral side of the rail;

a shaft extending laterally across the rail between the base member and the frame;

a lever that is pivotably attached to the shaft adjacent the frame and being rotatable between an open position wherein the frame and base member can be disengaged from the rail and a closed position wherein the frame and base member directly engage the rail such that the frame compresses the base member into engagement with the top side of the rail and biases the frame into the second lateral side of the rail and biases the frame into engagement with the second lateral side of the rail;

a fastener engaged with an end of the shaft that is opposite the lever to define a position of the base member relative to the frame when the lever is closed;

a pivot pin that engages the shaft and extends in a crossing direction relative to an axis of the shaft, the pivot pin being eccentrically attached to the lever; and a notch formed in the shaft proximate the pivot pin that is configured to cooperate with a lock that is pivotably attached to the lever and prevent rotation of the lever relative to the frame when the lock is engaged with the notch.

12. The device of claim 11 wherein the fastener cooperates with the shaft such that a combined length of the shaft and fastener is toollessly adjustable to change the position of the base member relative to the frame when the lever is closed.

13. The device of claim 11 further comprising at least one spring disposed between the base member and the frame to generate a separating bias therebetween as the lever moves from the closed position to the open position.

14. The device of claim 11 wherein the fastener cooperates with a cavity formed in the base member.

15. The device of claim 11 wherein the shaft only partially overlies the base member so as to cooperate with the top side of the rail in an interfering manner.

* * * * *